US012049372B2

(12) United States Patent
Techlin et al.

(10) Patent No.: US 12,049,372 B2
(45) Date of Patent: Jul. 30, 2024

(54) METHOD FOR PRODUCING CORELESS ROLL PRODUCTS

(71) Applicant: Paper Converting Machine Company, Green Bay, WI (US)

(72) Inventors: Michael E. Techlin, De Pere, WI (US); Cory L. Schubring, De Pere, WI (US); Elijah Scriven, Green Bay, WI (US); Stefano Spinelli, Green Bay, WI (US); Scott K. Houle, Green Bay, WI (US)

(73) Assignee: Paper Converting Machine Company, Green Bay, WI (US)

( * ) Notice: Subject to any disclaimer, the term of this patent is extended or adjusted under 35 U.S.C. 154(b) by 524 days.

(21) Appl. No.: 17/350,213

(22) Filed: Jun. 17, 2021

(65) Prior Publication Data

US 2021/0403266 A1 Dec. 30, 2021

Related U.S. Application Data

(60) Provisional application No. 63/044,585, filed on Jun. 26, 2020.

(51) Int. Cl.
*B65H 18/14* (2006.01)
*B65H 18/02* (2006.01)
(Continued)

(52) U.S. Cl.
CPC ..... *B65H 18/14* (2013.01); *B65H 19/2292* (2013.01); *B65H 19/29* (2013.01);
(Continued)

(58) Field of Classification Search
CPC .. B65H 23/005; B65H 23/044; B65H 23/195; B65H 23/198; B65H 23/1935;
(Continued)

(56) References Cited

U.S. PATENT DOCUMENTS 4,238,084 A * 12/1980 Kataoka ..... B65H 23/1955 242/413.5
4,496,112 A * 1/1985 Olsson ..... B65H 18/145 242/414.1
(Continued)

FOREIGN PATENT DOCUMENTS

EP 3485086 B1 7/2020
WO 2016108843 A1 7/2016
(Continued)

*Primary Examiner* — Michael R Mansen
*Assistant Examiner* — Raveen J Dias
(74) *Attorney, Agent, or Firm* — Thompson Coburn LLP

(57) ABSTRACT

A converting line for coreless roll products includes a rewinding machine and a controller. A log of convolutely wound web material is wound in the rewinding machine during a wind cycle. A diameter of the log, a caliper of the web material, and an amount of tension of the web is determined at a plurality of time points during a time period of the winding cycle. The controller is enabled to generate a signal to change an operating condition of the converting line based upon at least one of a diameter determination at a time point during the wind cycle, a caliper determination at a time point during the wind cycle, a wound web amount determination at a time point during the wind cycle, and a tension determination at a time point during the wind cycle.

22 Claims, 15 Drawing Sheets

(51) Int. Cl.

| | |
|---|---|
| ***B65H 19/22*** | (2006.01) |
| ***B65H 19/29*** | (2006.01) |
| ***B65H 23/00*** | (2006.01) |
| ***B65H 23/04*** | (2006.01) |
| ***B65H 23/195*** | (2006.01) |
| ***B65H 26/08*** | (2006.01) |

(52) U.S. Cl.
CPC ..... *B65H 23/005* (2013.01); *B65H 23/044* (2013.01); *B65H 23/195* (2013.01); *B65H 26/08* (2013.01); *B65H 18/023* (2013.01); *B65H 19/2269* (2013.01); *B65H 2301/41432* (2013.01); *B65H 2511/114* (2013.01); *B65H 2511/13* (2013.01); *B65H 2511/14* (2013.01)

(58) Field of Classification Search
CPC ..... B65H 26/08; B65H 18/08; B65H 18/10; B65H 18/103; B65H 18/12; B65H 18/14; B65H 18/145; B65H 19/22; B65H 19/2238; B65H 19/2246; B65H 19/2269; B65H 19/2292; B65H 19/29; B65H 19/30; B65H 2511/142; B65H 2511/166; B65H 2511/13; B65H 2511/14; B65H 2513/10; B65H 2515/12; B65H 2515/31; B65H 2553/212; B65H 2220/01; B65H 2220/02; B65H 2301/46; B65H 2301/41432; B65H 2801/84; B65H 18/023; B65H 18/20; B65G 19/2292; B65G 2511/13
See application file for complete search history.

(56) References Cited

U.S. PATENT DOCUMENTS

| | | | | | |
|---|---|---|---|---|---|
| 4,976,473 | A * | 12/1990 | Tsujimoto | B65H 19/30 | 242/596.5 |
| 5,470,030 | A * | 11/1995 | Nielsen | B65H 23/1955 | 242/413.3 |
| 5,800,652 | A * | 9/1998 | Vigneau | B65H 19/29 | 156/449 |
| 5,806,785 | A * | 9/1998 | Laplante | B65H 26/08 | 242/563.2 |
| 5,820,065 | A * | 10/1998 | Altosaar | B65H 19/28 | 242/534 |
| 5,906,333 | A * | 5/1999 | Fortuna | B65H 19/1836 | 242/555.2 |
| 6,030,496 | A | 2/2000 | Baggot et al. | | |
| 6,189,825 | B1 * | 2/2001 | Mathieu | B65H 18/26 | 242/541.6 |
| 6,283,402 | B1 * | 9/2001 | Fordham | B65H 18/106 | 242/530.4 |
| 6,422,501 | B1 * | 7/2002 | Hertel | B65H 19/2269 | 242/532.3 |
| 6,755,940 | B2 | 6/2004 | Lin et al. | | |
| 7,000,864 | B2 | 2/2006 | McNeil et al. | | |
| 7,127,951 | B2 | 10/2006 | Sartain et al. | | |
| 7,293,736 | B2 | 11/2007 | Recami et al. | | |
| 9,284,147 | B2 * | 3/2016 | Techlin | B65H 75/2455 | |
| 9,932,190 | B2 * | 4/2018 | Wada | B65H 23/198 | |
| 11,174,595 | B2 * | 11/2021 | Montagnani | D21F 11/006 | |
| 11,247,863 | B2 * | 2/2022 | Techlin | B65H 18/22 | |
| 11,261,045 | B2 * | 3/2022 | Spinelli | G05B 13/021 | |
| 11,434,096 | B2 * | 9/2022 | Petras | C07D 401/14 | |
| 11,634,294 | B2 * | 4/2023 | Hiroyasu | B65H 19/1805 | 242/555.3 |
| 2002/0084375 | A1 * | 7/2002 | Watanabe | G03B 1/04 | 242/576.1 |
| 2002/0123417 | A1 * | 9/2002 | Cote | B65H 23/188 | 493/34 |
| 2003/0116296 | A1 * | 6/2003 | Lin | B65H 18/10 | 162/252 |
| 2009/0283565 | A1 * | 11/2009 | Ibanez | G01B 21/12 | 702/158 |
| 2011/0264254 | A1 * | 10/2011 | Nuyan | G05B 11/32 | 700/103 |
| 2012/0248651 | A1 * | 10/2012 | Conti | B65H 29/008 | 264/299 |
| 2013/0068874 | A1 | 3/2013 | Schwamberger et al. | | |
| 2013/0284849 | A1 * | 10/2013 | Mazzaccherini | B65H 19/2238 | 242/533 |
| 2017/0327335 | A1 | 11/2017 | Vergentini et al. | | |
| 2017/0327337 | A1 | 11/2017 | Bixler et al. | | |
| 2019/0301099 | A1 | 10/2019 | Montagnani et al. | | |
| 2019/0308839 | A1 | 10/2019 | Schubring et al. | | |
| 2020/0165091 | A1 | 5/2020 | Techlin et al. | | |
| 2020/0277153 | A1 * | 9/2020 | Spinelli | B65H 19/2269 | |
| 2020/0369048 | A1 * | 11/2020 | Gracia Verdugo | B41F 33/00 | |
| 2020/0385227 | A1 | 12/2020 | Petras et al. | | |
| 2021/0107756 | A1 * | 4/2021 | Meyer | B65H 23/198 | |
| 2021/0155436 | A1 * | 5/2021 | Haapanen | D21F 9/00 | |
| 2021/0261372 | A1 * | 8/2021 | Hiroyasu | B65H 26/08 | |
| 2021/0300708 | A1 * | 9/2021 | Kamigiku | B65H 26/08 | |
| 2021/0394387 | A1 * | 12/2021 | Acciari | B65H 18/16 | |
| 2022/0127093 | A1 * | 4/2022 | Hiroyasu | B65H 19/1889 | |

FOREIGN PATENT DOCUMENTS

| | | | |
|---|---|---|---|
| WO | 2018011033 | A1 | 1/2018 |
| WO | 2019185438 | A1 | 10/2019 |

* cited by examiner

METHOD FOR PRODUCING CORELESS ROLL PRODUCTS

RELATED APPLICATION DATA

This application claims the benefit of U.S. provisional application Ser. No. 63/044,585 filed on Jun. 26, 2020, the disclosure of which is incorporated by reference herein.

BACKGROUND

This disclosure is directed to a method for producing coreless roll products, and more particularly toward the production of coreless roll products known as canister wipes. Canister wipes are rolls of typically nonwoven substrates which are placed into plastic canisters and moistened with, for example, a cleaning or disinfecting solution, and sold to retail consumers and to large-scale organizations such as hospitals. The end user dispenses individual wipes from the canister, typically through an opening in the lid, in center-pull fashion where the sheets are taken from the center hole of the coreless roll. The rolls themselves may be produced on equipment similar to the equipment for producing rolls of consumer bathroom tissue and household towel, known generally as a converting line, and more specifically a converting line for producing rolls of coreless tissue/towel products. However, there are differences between tissue/towel roll products and canister wipes roll products in terms of the substrates, the roll specifications, and the roll quality standards, and in the equipment in the converting line. These differences drive a need for new methods for producing canister wipes, in order to realize the productivity advantages of tissue/towel converting equipment over the current state of the art.

As will become evident from the discussion that follows, the method described herein provides for sustained high throughput production of rolls of canister wipes of high quality. As will become evident in the discussion that follows, aspects of the methods described herein also have applicability in the production of tissue and towel roll products.

DETAILED DESCRIPTION

Figure 1:
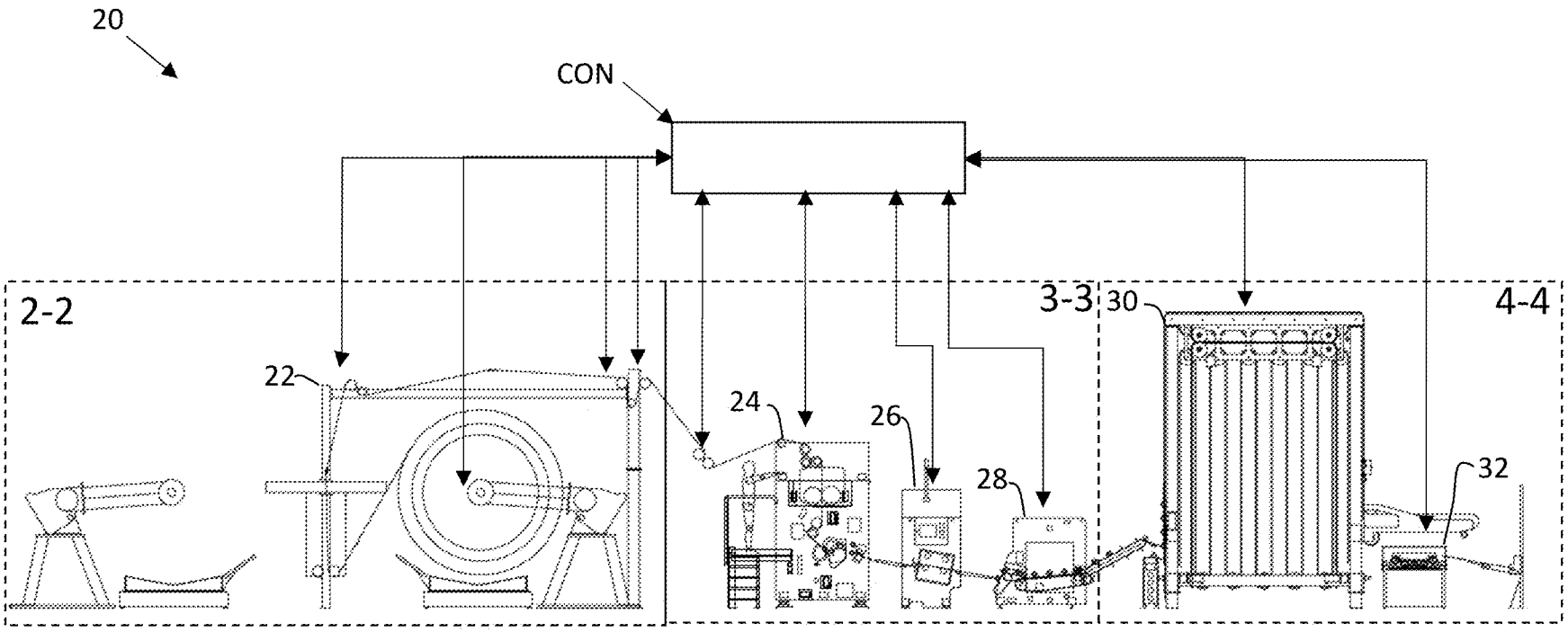
FIG. 1 is a side elevation of an exemplary line for producing roll products.
Figure 2:
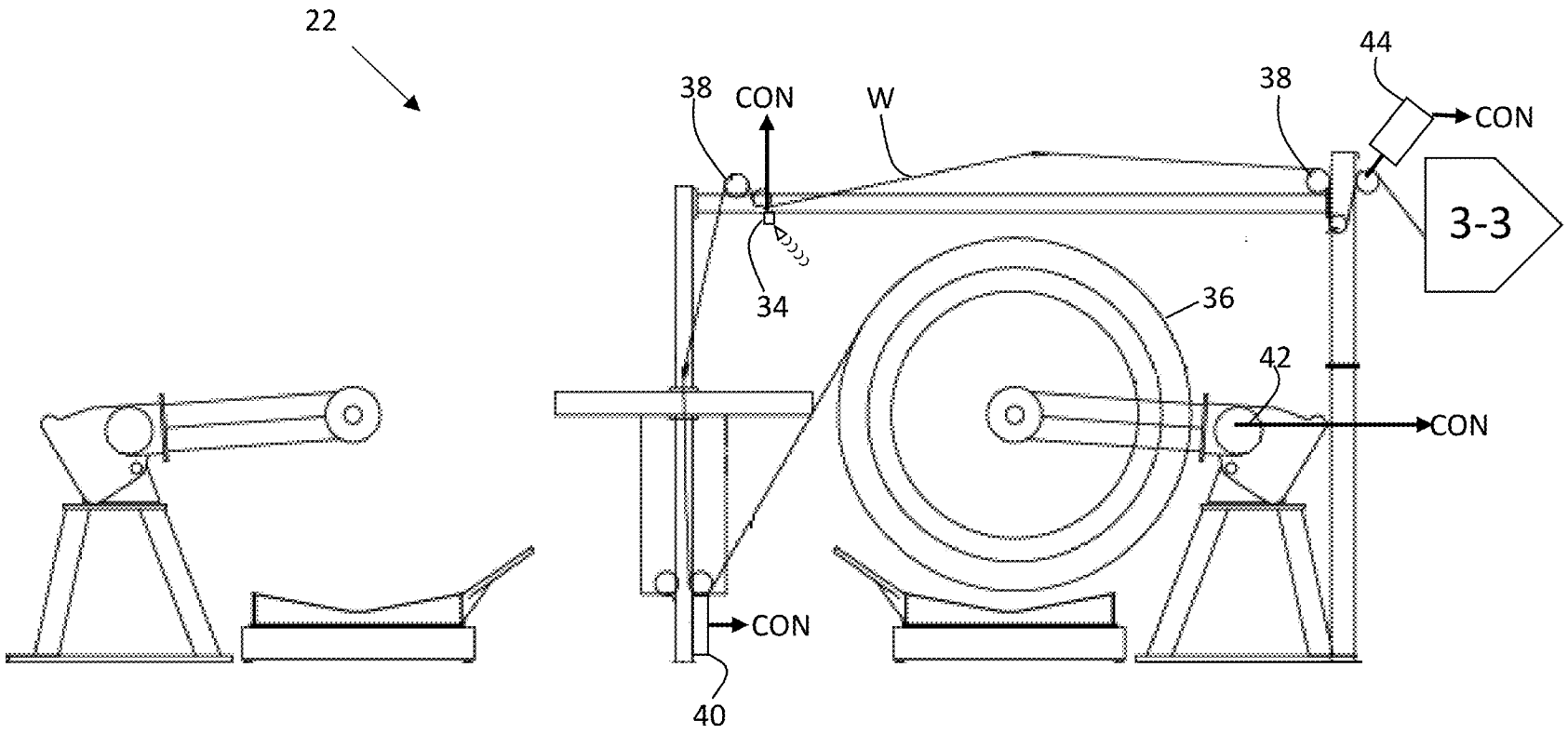
FIG. 2 is an enlarged view of area 2-2 of FIG. 1.
Figure 3:
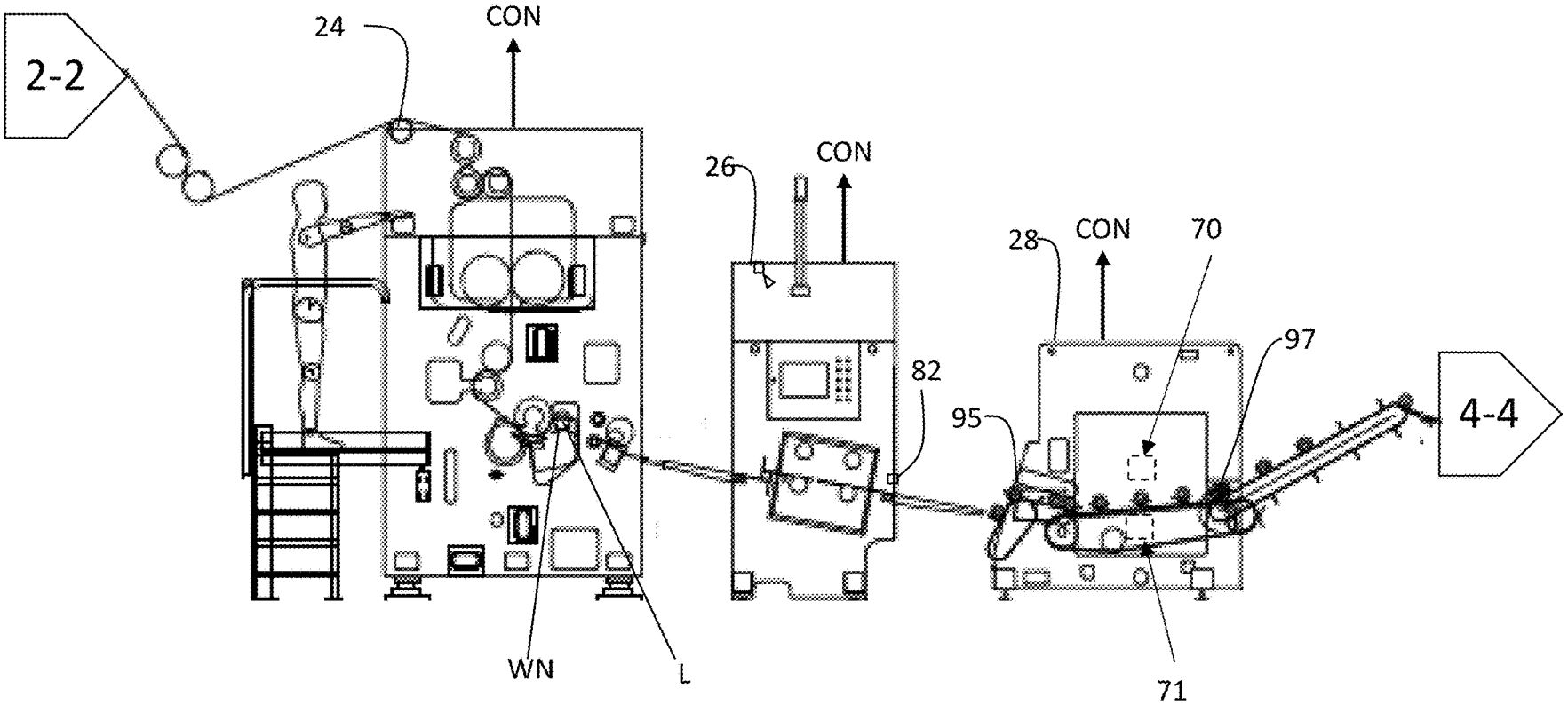
FIG. 3 is an enlarged view of area 3-3 of FIG. 1.
Figure 4:
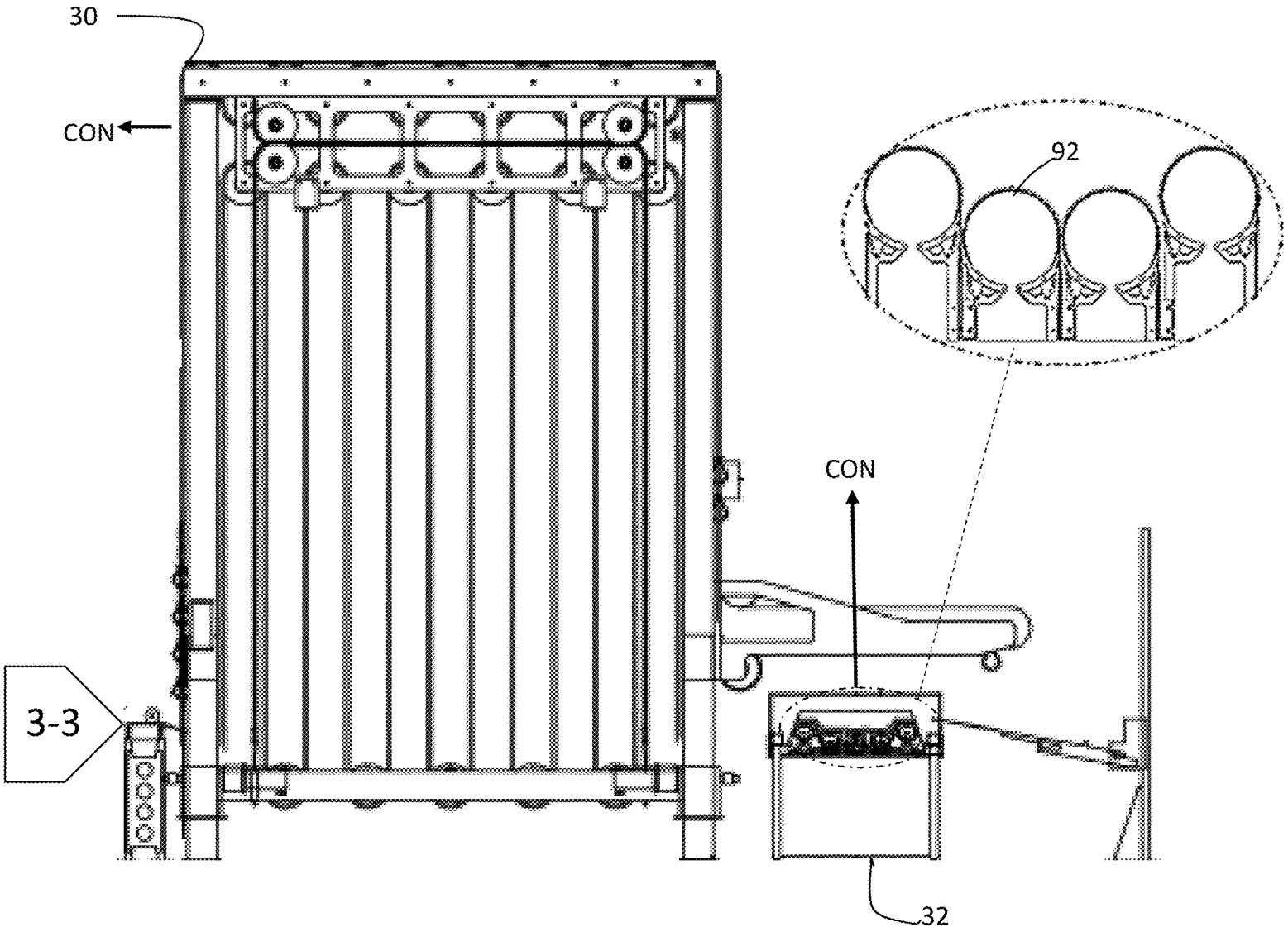
FIG. 4 is an enlarged view of area 4-4 of FIG. 1 with an inset showing additional detail of a log saw clamp.

An exemplary converting line for processing coreless roll products, and more particularly, canister wipes is shown in FIGS. 1-4. The converting line converts large parent rolls of web material into smaller rolls. The parent rolls are much wider than the final rolls. The parent rolls may be of sufficient width to be cut into, for example, 8-16 rolls of between 6 and 12 inches long. Parent rolls may have width of as much as 112 inches, and 138 inches, and greater. Parent rolls may have width of as little as 70 inches, and 63 inches, and less. Before they are cut to final length, the elongated rolls are known in the tissue/towel industry as logs. As shown in FIGS. 1-4, a converting line 20 for producing canister wipes may comprise, for example and not in any limiting sense, an unwind station 22, a rewinder 24, a tail seal unit 26, a mandrel extractor 28, a log accumulator 30, and a log saw 32. In FIG. 1, these machines are shown in succession. The rewinder 24 may be a surface rewinder, as shown in FIG. 1, in which the log L is supported and rotationally driven at its periphery in a winding nest WN. In the alternative, the rewinder may be a center rewinder, in which the log is supported and rotationally driven by a spindle, axle, or shaft within the log. Or the rewinder may be a center-surface rewinder, in which the log is supported and rotationally driven at its periphery, and rotationally driven from its center by a spindle, axle, shaft, or winding mandrel within the log. FIG. 2 provides more detail of the parent roll unwind station 22. FIG. 3 provides more detail of the rewinder 24, tail seal unit 26, and mandrel extractor 28. FIG. 4 provides more detail of the accumulator 30 and log saw 32, which may include a conveyor system feeding logs to the log saw. Equipment (not shown) downstream of the log saw 32 transports the rolls for further processing. The downstream equipment may include equipment for converging rolls from multiple log saw lanes into fewer lanes, or for diverging one log saw lane or multiple log saw lanes into a greater number of lanes. The downstream equipment may include machinery for placing the rolls into the canisters (this equipment is known generally as a canister loader, or a stuffer, and available for example from R. A. Jones in Covington, Ky.), adding a fluid to the canister, and capping, labeling, and packaging the canisters.

By way of example, the unwind station 22 may be in accordance with pending U.S. application Ser. No. 16/372897 (US 2019-0308839); the rewinder 24 may be in accordance with one of the several examples in the figures in pending U.S. application Ser. No. 16/416515 (US 2020-0165091); the log L may be formed and wound on the rewinder 24 in accordance with the principles described in U.S. Pat. Nos. 6,056,299 and 6,422,501; the log formation and winding process may be assessed, and the converting line controlled based on said assessments in accordance with the principles described in pending U.S. application Ser. No. 16/804311 (US 2020-0277153); the disclosures all of which are incorporated by reference herein.

The tail seal unit 26 may be in accordance with U.S. Pat. No. 5,800,652, the disclosure of which is incorporated by reference herein.

The roll product, the coreless production method and apparatus, and the mandrel extractor 28, may be in accordance with patents U.S. Pat. Nos. 9,919,888, 9,284,147, 9,975,720, and 10,676,304 and with pending U.S. application Ser. No. 16/851,714 (US 2020-0262669), the disclosures all of which are incorporated by reference herein.

The log accumulator 30 may be in accordance with those known in tissue/towel converting.

The log saw 32 may be in accordance with U.S. Pat. Nos. 6,644,154, 10,272,585 and/or with pending U.S. application Ser. No. 16/395369 (US 2020-0338676), the disclosures all of which are incorporated by reference herein.

As described below, differences between tissue/towel roll products and canister wipes roll products in terms of the substrates, the roll specifications, the equipment, and the product quality standards require new methods for sustained high throughput production of canister products of high quality. These criteria and an integrated control CON for controlling the converting line are described below.

From a substrate standpoint, while tissue products are made from natural fiber, and towel products are mostly made from natural fiber with some towel products including small amounts of synthetic fibers, substrates for canister products tend to have a much higher proportion of synthetic fibers than those for tissue/towel. Canister substrates tend to have a higher tensile strength than tissue/towel. Tissue/towel substrates tend to be mostly dimensionally stable in the machine-direction (length) and in the cross-direction (width) as they are unwound, while the web from a canister parent roll can change in length and width as it is unwound, even if the web is not subjected to an external force. The extent to which a canister web changes in length and width can change throughout the unwinding of a parent roll. Without being limited to any theory, it is believed that, during the process of producing parent rolls for canister products, the parent rolls are wound under tension, a residual tension remains wound into the parent roll, and this residual tension is relieved as the web is unwound from the parent roll. If a parent roll has residual tension, the web may grow in width and in caliper (thickness), and shrink in length, as or after it is unwound from the parent roll. Furthermore, if the tension under which the parent roll is being wound changes as the parent roll is being wound, there may be changes in the web length and width changing throughout the unwinding of the parent roll. Again without being limited to any theory, it is believed that canister substrates may exhibit this behavior to a greater extent than tissue/towel substrates because they have a higher yield strength in the machine direction and/or a higher modulus of elasticity in the z-direction (i.e., the thickness direction). Because canister substrates tend to have greater elasticity, when wound under high tension during the parent roll winding process, which can be done because the substrates tend to be strong, the web is stretched longer and also decreases in width and thickness. After unwinding from the parent roll, when the web is at relatively lower tension, it contracts in length due to an elastic return force, and tends to increase in width, and may also increase in thickness. Often, parent rolls of canister substrates are wound under high tension due to the desire to have as much linear footage on a parent roll as possible, in order to maximize the efficiency of the parent roll production equipment by minimizing the time between "turn ups", maximize the efficiency of the converting line by minimizing the time between parent roll changes, and maximize the economy when transporting parent rolls from the location of production to the location of converting to finished rolls. Some canister parent rolls exhibit caliper reduction near the parent roll core similar in nature to that well-known in tissue/towel parent rolls, especially through-air dried (TAD) parent rolls. As will become evident from the discussion that follows, other aspects of canister substrates drive a greater need for methods and machinery that can adapt and accommodate greater processing variations than those ordinarily seen with the processing of tissue/towel roll products.

Another major difference between tissue/towel roll products and canister products from a roll specification standpoint is the roll diameter. The diameter of tissue/towel products is 90 mm or larger. The diameter of many canister products, including most sold to consumers, is less than 90 mm, for example and not in any limiting sense, 65 mm and 85 mm. These small diameter logs tend to have low bending stiffness, which is further exacerbated by the lack of a core. The central holes in the rolls are typically 25-40 mm and often 35-38 mm diameter. As the log diameter is decreased, the difference between the hole diameter and the roll diameter also decreases, and the radial thickness of the web material wrapped in the roll decreases. This means forces applied at the log periphery transmit efficiently to the log center. This also means that these logs and finished rolls tend to have less resistance to collapse from radial loads applied at the periphery after the mandrel has been removed. Some grades of canister substrates may slip against themselves more easily, so telescoping during stripping or extraction can be an issue, as well as exacerbating the issue of collapse from radial loads at the roll periphery after the mandrel has been removed. Some canister products, especially those sold more often for institutional use or for shop use rather than for household use, have larger roll diameters.

There are other key differences in the roll quality standards between tissue/towel roll products and canister products. One difference is in cut quality. In most cases with tissue/towel, the rolls must have a clean-cut end for appearance and for reliable operation of equipment downstream of the log saw. This clean-cut end is usually produced by trimming the ends of the logs in the log saw and removing the resulting trim "cookies" which can then be re-pulped or recycled. With canister products, because the consumer does not see the end of the roll (except when opening the can to find the tail of the roll to start dispensing, at which time he or she does not particularly care what the cut looks like), and because any trim cookies are less readily recycled, the entire length of the log is used.

Another difference is in roll diameter tolerance. With consumer tissue/towel rolls, a tight tolerance (for example, plus or minus 1 mm) on diameter is often required for consistent appearance to the consumer, as well as for reliable operation of equipment downstream of the log saw. With canister products, the main concern is that the roll fits inside the canister; while there is a lower limit on diameter, to avoid the situation of a too-small roll rattling inside the canister, which a consumer may perceive negatively as low quality or being shorted product, in general the diameter tolerances are looser with canister products than with tissue/towel. Furthermore, some downstream equipment that places rolls inside canisters runs more reliably with varying diameter rolls of consistent firmness than with varying firmness rolls of consistent diameter. However, if a converting line is operated to control the log firmness and/or control variation of the log firmness, then provisions may be required for the line to accommodate attendant variation of the log diameter as the caliper or other properties of the substrate vary.

Another difference between tissue/towel roll products and canister products from an equipment standpoint is the lack of an embossing station between the unwind and the rewinder. In the tissue/towel roll processing, the embossing station may be used as a mechanism to adjust caliper and tension. In canister product processing, the caliper of the canister substrate is not altered by any equipment between the unwind and the rewinder. Thus, in canister products, canister substrate web caliper must be controlled during the rewind process, which as described above may be subject to multiple variables and competing factors.

The nature of the canister substrates may not be compatible with standard tissue/towel roll product processing equipment. For instance, coatings such as tungsten carbide on draw rollers and wind nest rollers of standard tissue/towel roll product processing equipment may be unsuitable with canister substrates. These aggressive coatings may pick and tear the canister substrates. Plasma spray coatings, such as those available from American Roller Company of Union Grove, Wis., may be more suitable roller coatings for lines producing canister products, especially canister products wound of nonwovens substrates.

The high tensile strength of canister substrates may mean that perforation bonds for canister products must be further apart when compared to the perforation bonds on tissue/towel rolls in order to provide for a perforation tensile strength suitable for dispensing. Perforation bonds spaced far apart may result in longer than desirable unconnected spans of web at the ends of the log, which could result in process upsets. Several more closely spaced bonds at each end of the web may reduce these process upsets. Even with perforation bonds that are small and/or spaced apart, when a consumer dispenses a canister roll product by pulling a wipe out of the canister and breaking the wipe at the perforation, there may be residual tufts of stringy material at each of the perforation bond sites. This may be perceived by consumers as a quality defect. One solution is to mount a second perforator in series with the first, which is known from consumer tissue and towel equipment for quickly changing between perforation length ranges. The second perforator may be equipped with a perforation blade adapted and configured to make second perforation incisions spaced away from the first perforation bond sites in the web travel direction, in the same cross-direction locations as the first perforation bond sites. The second perforation incisions may shorten the residual stringy tufts when the wipe is dispensed. Because the perforation bond may be more reliant on cross-direction strength of the substrate in this case, the bond area of the first perforation may need to be increased.

If an automatic splicing unwind is provided, known tissue/towel methods of cutting off the web of the expired parent roll by engaging a serrated blade across the width of the web may be insufficient for canister substrates with higher tensile strength. One alternative suitable for canister substrates is to apply known technology from unwinds used in the production of folded disposable wipes. Accordingly, a disc or a wheel attached to a rotating actuator, for example an air motor, may be provided. The wheel and motor assembly may be arranged on a linear actuator, for example a servo motor driven rod-less cylinder. The wheel and motor assembly may traverse the width of the web with the driven rotating disc or wheel to cut off the web of the expired parent roll. This may add a small amount of time to the splicing sequence relative to the known tissue/towel cutoff methods, but may provide for positive, reliable cutoff of canister webs.

The combination of mandrel diameter, log diameter, product length, and substrate web caliper define how tightly a roll is wound. Wind tightness can be calculated as wound-in caliper compression, or how much thinner a substrate becomes relative to its measured caliper before winding, when a given length is wound to a given roll diameter with a given hole diameter. Wound-in caliper compression is typically reported in terms of percent. While different substrates may have different ranges of desirable wound-in compression, in general a modest amount of positive wound-in compression is desirable. The more lofty and bulky a substrate (i.e. the more similar it is to consumer tissue grades), the wider the operating window of wound-in compression may be. The less lofty and bulky (i.e. the more similar it is to plastic film), the narrower the operating window of wound-in compression may be. If substrates have caliper drop-off, for example, near a splice within a parent roll or at the end of a parent roll, it may make sense to design the canister roll products to have a target wound-in compression at the high end of the canister substrate's acceptable wound-in compression range in order to allow for some degree of caliper drop-off. Two canister substrates of different calipers may have very different results if run with the same combination of mandrel diameter, log diameter, and product length.

With this in mind, the converting line 20 uses a control CON and sensors throughout the converting line in an integrated manner to control the converting line. In particular, the control CON processes sensor signals related to log diameter, web caliper, wound web amount, and web tension throughout the converting line, and processes the data and information relative to a database of information on these parameters to control the converting line. Accordingly, the control CON may have a processor and database and be enabled to process the sensor information to determine log diameter, web caliper, wound web amount, and web tension based on the sensor signals throughout the converting line. Parameters such as the amount of web material paid off the parent roll and wound into logs may be determined indirectly based upon log diameter and web caliper information.

As mentioned in co-owned and co-pending application Ser. No. 16/372897 (US 20190308839), to determine caliper and the amount of web unwound from the parent roll, at least one sensor 34 may be positioned in the unwind station 22 to measure the distance between the sensor and the parent roll 36 loaded in the unwind station. Unwinding of the parent roll 36 on unwind station 22 delivers the web of material W to other equipment in the converting line 20 through web handling rolls 38, which may include one or more rolls with associated drives 40 that are in communication with the control CON. Operation of the unwind station 22 and the rate of rotation of the parent roll may be controlled with a drive 42 of the unwinder station that is in communication with the control CON. Both the drive 42 of the unwind station 22 and drive(s) 40 of the rollers 38 may interface with the control CON to control operation of the converting line 20. The unwind station 22 may utilize diameter sensors 34 to develop diameter and caliper measurements during the unwind process. For instance, the sensors 34 may use laser time-of-flight technology to calculate the distance from the sensor to the surface of the parent roll 36, thereby effectively measuring the radius of the parent roll, and after successive revolutions, measuring the difference in radius of the parent roll to estimate web caliper.

The measurements of the radius of the parent roll 36 may be sampled continuously from multiple sensors 34 located about the parent roll 36 during the unwind process. The data may be collected continuously and transmitted to the processor of the control CON of the converting line 20. The processor may access the database to store data representative of diameter and caliper in the database. The processor may be further configured to perform regression analysis on the data. For instance, the processor may use a regression model that may continuously update the coefficient (b) and constant (C) as a function of the amount of web material delivered from the unwind station 22. The data to be analyzed may be stored in a first in first out (FIFO) database stack, allowing for a continuously adapting fit of the recent history of the running parent roll. As discussed above, it is known that the caliper of the web material W of the parent roll, especially for canister roll substrates, changes throughout the parent roll and is not consistent throughout the parent roll. With this in mind, for a particular substrate and converting process, the size of the FIFO database stack and sample interval may be adjusted as necessary taking into account also the accuracy of the sensor(s) 34 and the need to identify the data signifying a change of the caliper. The sample interval may also be randomized within a range so as to minimize the potential of sample aliasing of the non-uniform shape of the parent roll. A digital filter may also be employed to remove out of band noise from any signals prior to generating the data stored in the FIFO database. Once the data is fit, the derivative of the regression equation can be evaluated.

It has been determined that an adequate function for the regression analysis is $b/(2\cdot SQRT(bx+C))$. The method has been proven useful in describing the rate of change of diameter ($2\times R$) per amount of web delivered. At a given location on the circumference of the parent roll 36, the change in diameter ($A(2\times R)$) in one revolution of the parent roll effectively equates to two times the caliper at unwinding. The final form leverages the regression value for diameter at the discrete time of sampling such that $Caliper=\{[b/(2\cdot SQRT(bx+C))]\cdot[\pi\cdot SQRT(bx+C)]\}/2$, which simplifies to $\pi b/4$.

The above analysis to develop estimates of caliper during sampling intervals during the unwind process may be utilized in several ways to enhance the converting process. Diameter ($2\times R$) and caliper data may be used by the control to effectuate real-time control of downstream equipment in the converting line, such as a rewinder. As discussed above, large diameter parent rolls of canister substrates of web material exhibit decreasing unwinding caliper and higher in-wound stress during unwinding. As the finished diameter of a web material of the parent roll 36 increases, the winding profile and the effects of overwrapped sheets and roll weight have an increasing effect on the inner wound properties and subsequently how the unwound web material behaves through the converting processes. By monitoring for changes in caliper WC and diameter ($2\times R$) as the parent roll unwinds, the downstream web handling and processing equipment may be adjusted as needed to enhance line efficiency.

One or more of the web handling rollers 38 downstream of the unwind station may include a driven, high traction roller. One or more of the downstream rollers 38 may be configured to operate to balance the outgoing web velocity and upstream span strain. At least one of the downstream rollers 38 may be configured to maintain a standard velocity/position loop configuration to generate the baseline command for the target torque output with the above loop trimming to achieve the desired web force while damping the relative band of velocity trim based on the sheet modulus and tensile properties. The unwind station drive 42 may be trimmed by tension feedback located on a load cell 44 downstream from the unwinding process. There may be other tension control zones trimmed by further downstream rollers. The feedback tension load cell may be located on any number of rollers downstream. The controller may also use the hardware's native loops and be configured to use appropriate feedforward signals to compensate for roll inertia and commanded dynamics. The velocity (and optionally position) loops may be (de)tuned to be behave as over-damped, which may prevent the driven roller from exciting secondary resonances and high peak stress (rapid torque rise) while still providing a more uniform web payout. An amount of the web material unwound from the parent roll 36 may be based upon the processed diameter measurements and caliper determinations. Again, converting line controls signals based upon log diameter, web caliper, wound web amount, and web tension can assist in more efficient line operation.

Diameter measurements of the log during the winding process may be in accordance with that shown in co-pending application Ser. No. 16/804.311 (US 2020-0277153) the disclosure of which is incorporated by reference herein. For instance, an image capture device may be used in connection with the log L being wound in the winding nest WN of the rewinding machine 24.

Following are undesirable product and process outcomes of winding coreless rolls too loosely and too tightly.

Product wound too loosely:

Winding is unstable with log vibration

Logs telescope when mandrels are pulled in the mandrel extractor

Logs collapse radially when dropped into log saw

Logs collapse axially when pushed into the log saw

Rolls are not sufficiently dimensionally stable for the canister stuffer

Product wound too tightly:

Perforations break under tension

Hole collapses on itself

Winding mandrel does not extract from the log

Cleaning solution does not absorb consistently

Product does not dispense easily from the canister

If log diameter, sheet length, and sheet count remain unchanged as a parent roll is unwound (obviously mandrel diameter remains constant as a parent roll is unwound), and the caliper of the substrate changes, the wound-in caliper compression of the log will change. If the caliper decreases significantly, the rewinder may not be able to produce a log at the target diameter, instead producing an undersized log diameter. A known solution when web caliper gets thinner is to add sheets to the roll, make each sheet a little longer, and/or reduce the speed of the rewinder, which may not be economical. Other methods may be employed to retain the target log diameter, such as reducing the speed of the lower roller in the rewinder, in the case of a surface rewinder. However, winding the same log diameter of thinner web will typically produce a less firm roll, with less wound-in caliper compression, which is often not acceptable for the downstream equipment in a canister roll converting plant. Another method is to reduce the web tension. Reducing the web tension may be a useful remedy in cases where the web has increased thickness when it is subjected to lower tension. Therefore, controlling the web tension may be an advantageous method of controlling the roll diameter and/or the roll firmness for canister roll products.

The fact that canister substrate properties may vary from parent roll to parent roll, and that canister substrate properties may vary over time as a single parent roll is unwound, even if it is not subjected to an external force, combined with the fact that there is no embossing station between the unwind and the rewinder with which to impact the canister substrate properties by attenuating changes over time or by smoothing out variations across the substrate, may heighten the need for a well-engineered web handling and tension control system for a processing line, such as that described in pending U.S. patent application Ser. No. 16/372897 (US 2019-0308839). A well-engineered web handling and tension control system may improve reliability of a converting line for canister products by minimizing and/or maintaining control over external forces applied to the canister substrate as it is unwound from the parent roll 22, transported to the rewinder 24, and rewound into logs in the rewinder. Minimizing and/or maintaining control over external forces applied to the canister substrate may also improve the reliability of subsequent machine modules in the converting line and/or the reliability of downstream equipment.

Using a web handling and tension control system for a processing line, such as that described in pending U.S. patent application Ser. No. 16/372897 (US 2019-0308839), enables the monitoring of varying canister substrate properties at multiple points in the processing line. Varying web properties may be detected by monitoring process draw, which can be determined by monitoring and comparing torque on guide roller motors at different locations along the web path. Varying log properties may be monitored by monitoring the torque on the motor which extracts the mandrels. Varying web properties may be inferred from varying log properties. For instance, if the canister substrate web caliper gets thinner, the logs naturally have smaller diameter, with a wound-in compression which may still be within the operating window. A problem may occur if these undersized logs do not meet the rider roll in the rewinder and the machine jams when the logs fail to discharge from the rewinder. Automatically adjusting the wind nest settings based on measurements of the actual log diameters produced may reduce occurrences of such machine jams. If diameter adjustments are also made throughout the rest of the line as described in more detail below, it may result in more reliable operation of the converting line and of equipment downstream of the log saw.

Figure 5:
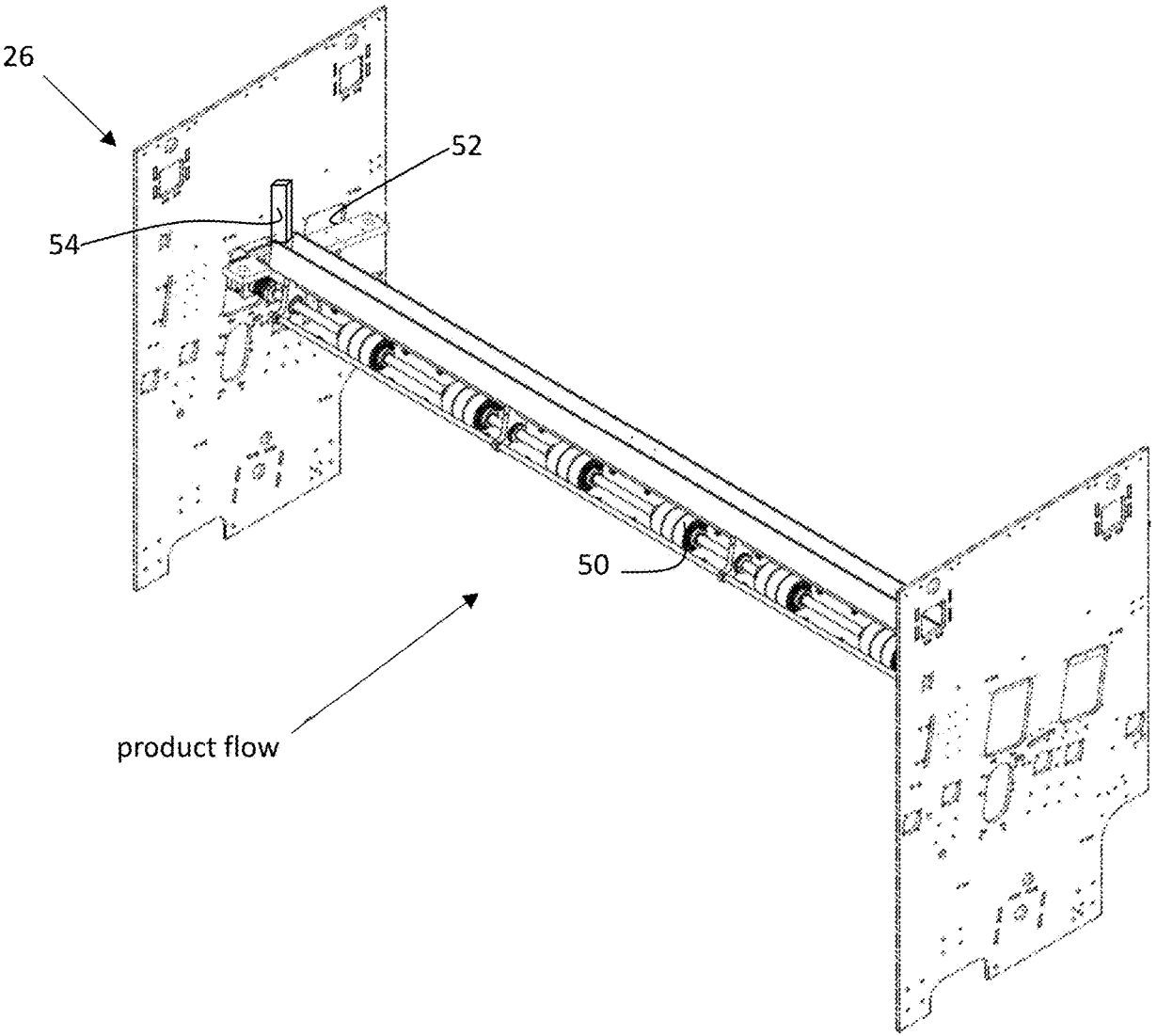
FIG. 5 is a perspective view of an upper winding roller or "no crush" winding roller in a tail seal unit.
Figure 6:
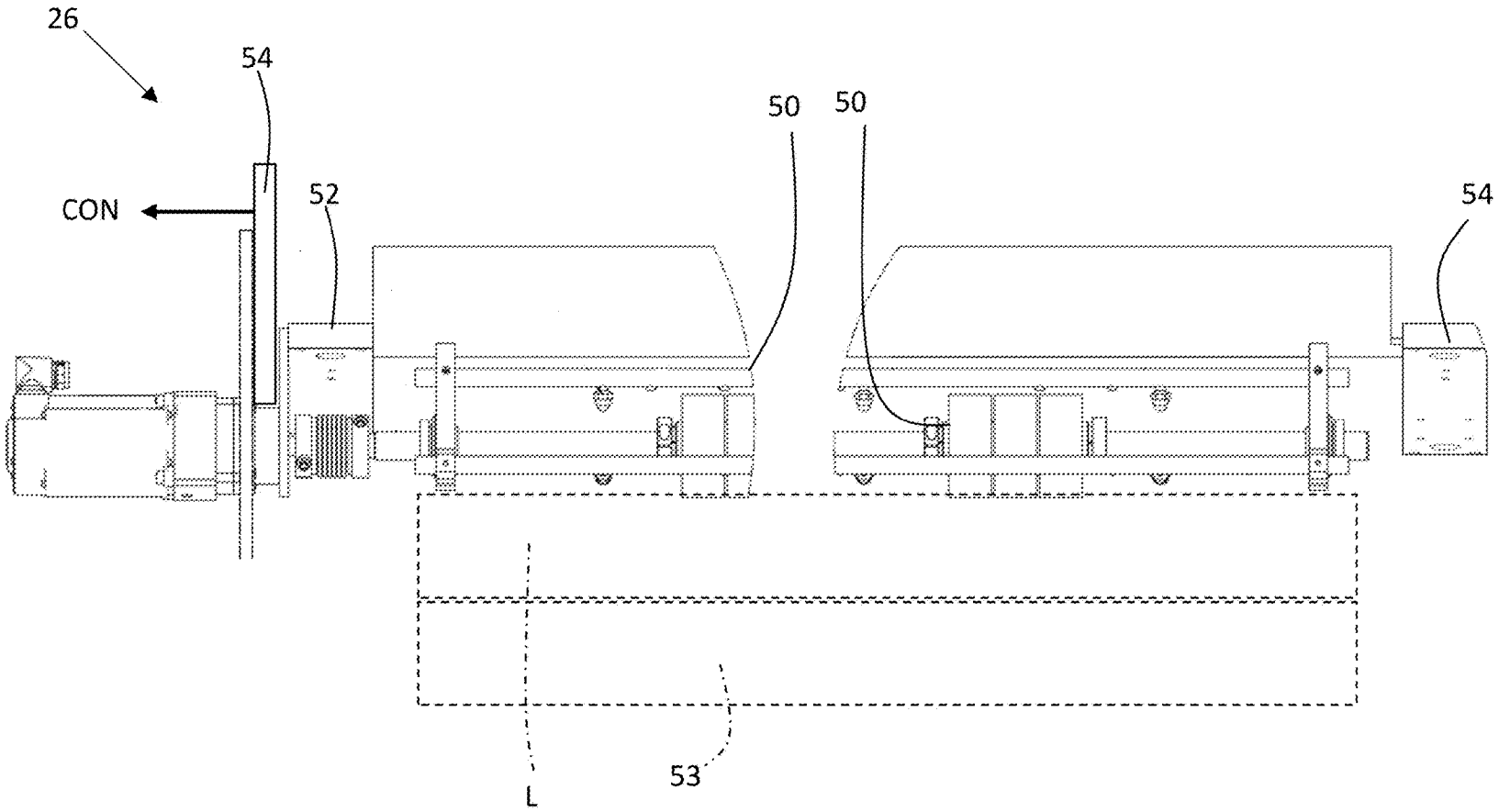
FIG. 6 is a partial front view of the roller of FIG. 5.

In addition to a control configured to accommodate variations in the canister substrates of the web material wound in the parent roll, other converting line equipment may be modified to include enhancements for processing canister products. For instance, in the tail seal unit 26, the standard rigid upper infeed roller 50, as shown in FIGS. 5-6, may be replaced with a compliant design more adaptable to varying log diameter and/or log firmness. The upper infeed roller 50 may include "no crush rollers", for example from Wagner Industries Inc. of Frackville, Pa. 17931, which may be suitable. In addition, or in the alternative, the height of the upper infeed roller 50 and upper tail press roller (not shown; see, e.g., '58' U.S. Pat. No. 5800652) may be changed automatically based on the diameter of the log entering the tail seal unit 26. The movement may be relative to a stationary lower roller so as to accommodate the diameter of the log as the log passes between the nips of the rollers 50,53. In FIG. 6, the lower roller 53 is shown in phantom. Axial ends of the upper infeed roller and the upper tail press roller may translate in the direction transverse to product flow on roller height adjustment guideways 52 to accommodate the diameter of the log entering the tail seal unit. A linear actuator 54 may position respective axial ends of the upper infeed roller and the upper tail press roller along the roller height adjustment guideways 52. Sensors may be utilized to sense the diameter of the log entering the tail seal unit, and corresponding position signals may be generated by the control CON and transmitted to the linear actuator 54 to position the respective axial ends of the upper infeed roller and the upper tail press roller along the roller height adjustment guideways 52 as needed.

In addition, modifications may be made to the mandrel extractor 28 to facilitate processing of canister substrates of web material. The logs of canister substrate web material may be surface wound, center wound, or combination center and surface wound on mandrels 60, and after log formation, the mandrel may be removed from the logs with a mandrel extractor. The winding mandrels 60 may be of a type disclosed in patents U.S. Pat. Nos. 9,284,147 and 9,919,888. The mandrels 60 may be comprised of flexible and elastic material. The mandrels 60 may be axially elastic. The mandrels 60 may be tubular and radially compliant. The mandrels 60 may elongate in length when pulled axially for extraction. The mandrels may reduce in diameter when pulled axially for extraction. Such mandrels are beneficial for producing canister rolls at high rates and without defects. Such winding mandrels are more tolerant of a tightly wound roll than a rigid mandrel would be, and more tolerant of increasing wound-in compression than a rigid mandrel. The mandrel extractor 28 may be configured for a period of slow mandrel pull during the initial stages of mandrel extraction to help the mandrel 60 stretch and break free from the interior of the log and help ensure reliable extraction with minimal distortion of the product. The duration of the slow pull and velocity of the slow pull may be increased or decreased and adjusted as necessary to help ensure reliable extraction. The mandrels 60 may be rotated relative to the wound log before or during extraction to smear the transfer adhesive, as disclosed in U.S. Pat. No. 9,975,720. An end of the mandrel may be engaged for pulling by a clasp as disclosed in U.S. Pat. No. 10,676,304.

Figure 7:
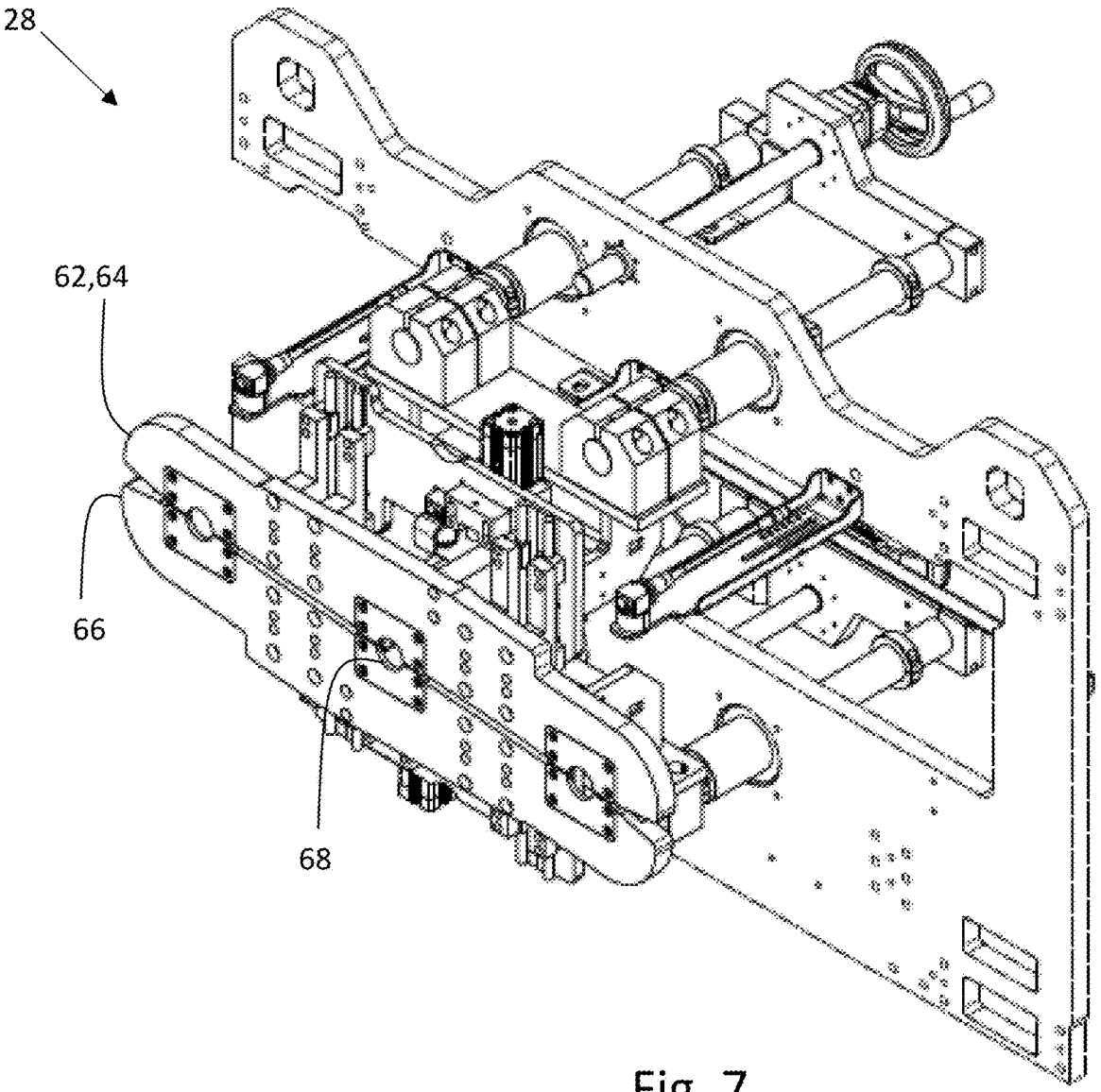
FIG. 7 is a perspective view of actuating face restraints of a mandrel extractor.
Figure 8:
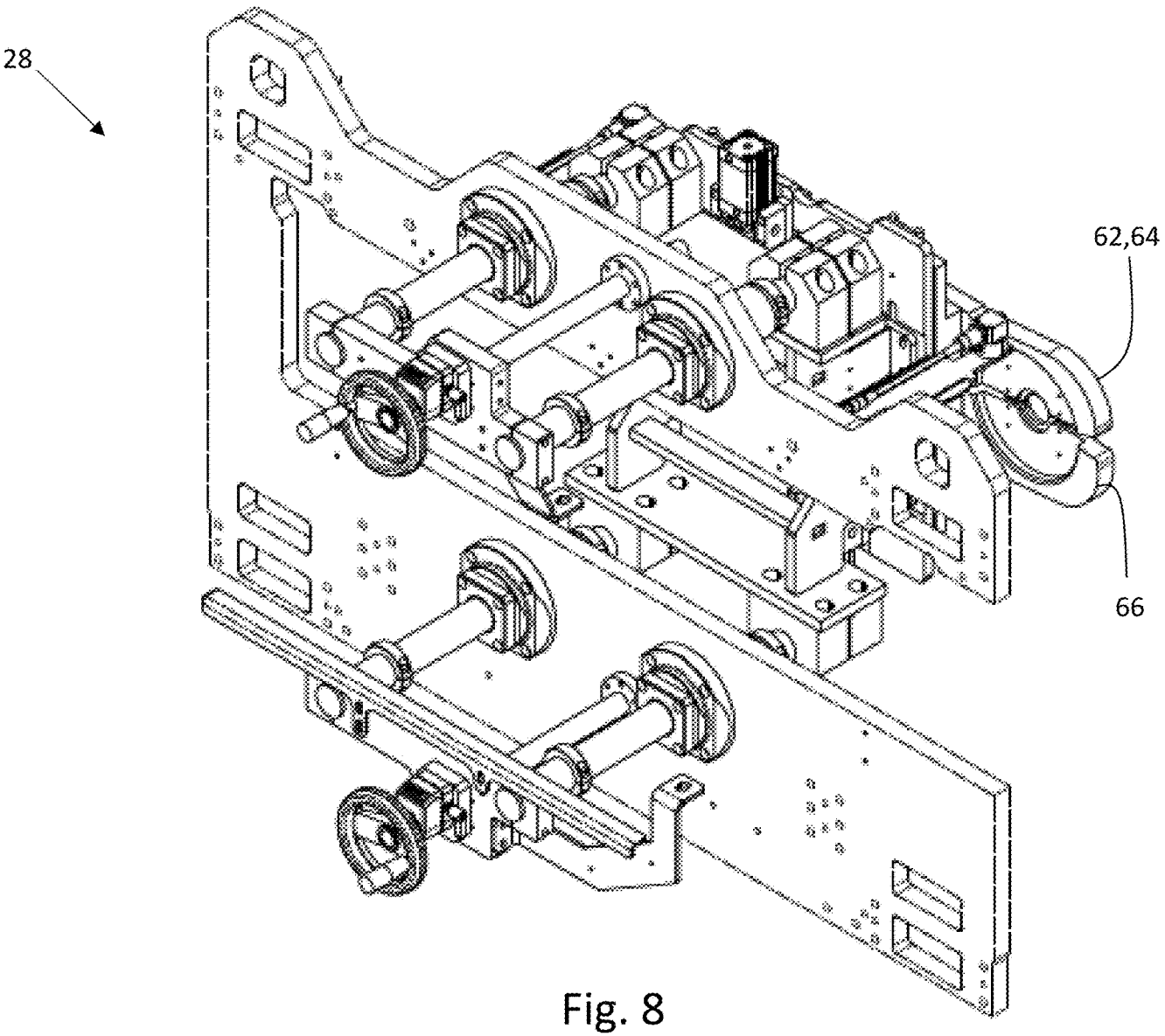
FIG. 8 is an alternate perspective view of the actuating face restraints of the mandrel extractor of FIG. 7.
Figure 9:
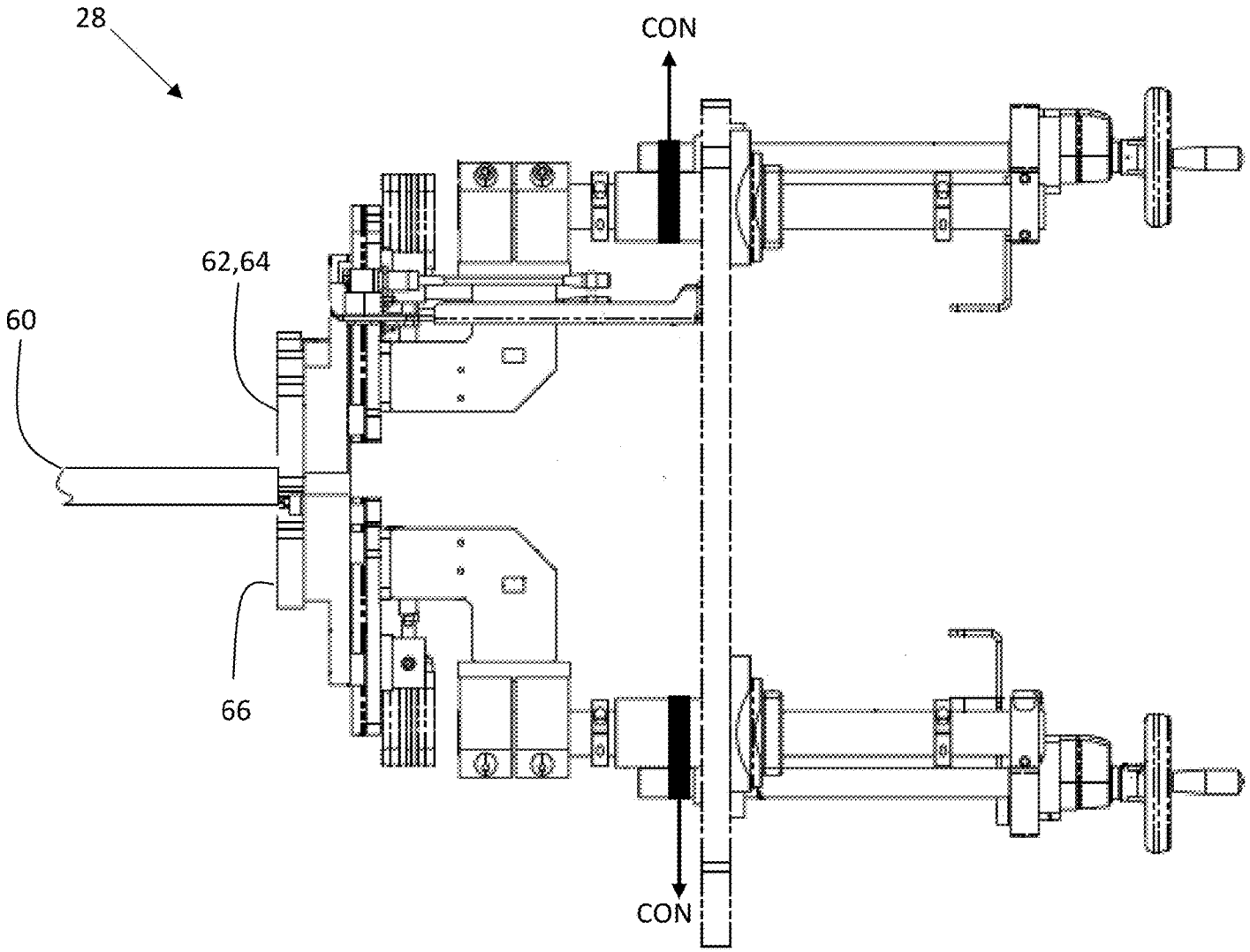
FIG. 9 is an end view of the actuating face restraints of the mandrel extractor of FIG. 7.

Additionally, in the mandrel extractor 28, the face restraints 62 may be arranged to enhance their contact with the ends of the logs to restrain them while the mandrels are extracted. As shown in FIGS. 7-9, actuating log face restraints 62 may be used to maximize contact with small cross-sectional area log ends and minimize the possible adverse issue of telescoping. The log face restraints 62 may have upper and lower portions 64,66 that may be movable relative to each other between a spaced position and closed position during processing. In the spaced position, the upper and lower portions 64,66 of the face restraints are spaced from each other to allow the mandrels 60 to pass between the portions as logs are loaded into the extractor 28 and the mandrel ends are positioned for extraction. Once the mandrel ends are in position, the upper and lower portions 64,66 of the face restraints 62 may move to the closed position so that the upper and lower portions abut or are at least adjacent one another and maximize surface contact with the axial end of the log prior to mandrel extraction. The upper and lower portions 64,66 of the face restraints 62 may move together between the spaced and closed positions, or one portion may move relative to the other between the spaced and closed positions. An opening 68 in the log face restraint 62 may be formed when the upper and lower portions 64,66 of the face restraints are in the closed position for each mandrel end to extend through the opening to allow passage of the mandrels for extraction.

Because of the tendency of some canister webs to change dimensionally as they are unwound from the parent roll, and to continue to change dimensionally after being wound into logs, log axial length, caliper, firmness, and/or diameter may change during processing of the canister products. If the time the logs rest between winding and mandrel extraction is too long, the mandrels may fail to extract. Failed extractions may be due or partly due to the transfer glue transitioning to a gel state. If the web length continues to decrease in the log, after a log is wound, the wound-in caliper compression may increase and the log can become wound more tightly on the mandrel, posing challenges for mandrel removal. Failed extractions may be due or partly due to the web constricting tighter on the mandrel as the log rests. Thus, for canister products, it may be desirable to minimize the time the logs rest before mandrel extraction during slow running of the line for parent roll splicing (in a line with automatic splicing unwinds), or during stopping of the line for parent roll change (in a line with a non-splicing unwind). During periods when the line is running more slowly than normal or is stopped, the extractor may continue operating at normal rate until no logs are waiting for mandrel extraction, instead of waiting for a full complement of logs from which to extract mandrels. Canister webs changing dimensionally may also be manifested as an increase in web tension when the line is stopped. This increase in web tension may be significant, including to the point of causing an already perforated web to break at a perforation. In such cases, having the parent roll pay out more web to keep the tension from rising to unacceptable levels, may be a suitable remedy.

Making reference to FIGS. 12-16, an upper peripheral restraint assembly 70 may make contact with the outside of the logs to restrain them during mandrel extraction. The upper peripheral restraint assembly and its operative location in the extractor 28 is shown in phantom in FIG. 3 and indicated by reference character 70. A lower peripheral restraint assembly may be provided. The lower peripheral restraint may be in accordance with patents U.S. Pat. Nos. 9,919,888, 9,284,147, and 10,676,304 and with pending U.S. application Ser. No. 16/851,714 (US 2020-0262669). A lower peripheral restraint assembly may be arranged substantially as a mirror of the upper peripheral restraint assembly 70, but beneath the logs facing upward rather than above the logs facing downward. A lower peripheral restraint assembly and its operative location in the extractor 28 is shown in phantom in FIG. 3 and indicated by reference character 71. The upper peripheral restraint assembly 70 may apply radial compression to the logs, which may be reported in terms of percent. The upper peripheral restraint assembly 70 may have roughened engagement surfaces 80 where it contacts the logs to afford friction at the interface with the logs. Correct engagement of the upper and lower peripheral restraint assemblies may be important for canister products. Too little pressure and the log may slide in them and crumple against the face restraint. Too much pressure and it may increase the extraction force to an unacceptable level. If the peripheral restraint assemblies operate solely under position control, changes to log diameter and firmness may alter the pressure applied by the peripheral restraint assemblies. In the case of canister products made from essentially flat sheet webs (i.e. webs that are less lofty and compressible than consumer tissue webs which tend to be lofty and bulky due to their manufacturing method or applied embossing), the pressure variation may be large when the product changes a little. When the caliper gets thinner, the log may slide in the restraints instead of being held firmly because the contact pressure of the peripheral restraints on the log is reduced. When the caliper gets thicker, the contact pressure of the peripheral restraints on the log may increase, and be transmitted radially through the log to the interface of the mandrel and initial log windings, increasing the force required to withdraw the mandrel. In the standard tissue/towel extractor, the amount of log compression in the peripheral restraints, with respect to the target log diameter, may be entered by the operator into a human-machine interface (HMI) in percent. In this case, the travel of the upper peripheral restraint assembly 70 toward the logs is governed by position control. If the actual diameter or firmness of the logs is significantly less than target, then the upper peripheral restraint assembly contact pressure can be too low. If the actual diameter or firmness of the logs is significantly greater than target, then the upper peripheral restraint assembly contact pressure can be too high. At the end of a parent roll, the operator may set a higher compression value to deal with undersized logs and then have too much pressure after the splice, when the caliper is thicker at the start of the parent roll. At the start of a parent roll, the operator may set a lower compression value to deal with the larger logs, and then have too little pressure toward the end of the parent roll. It would be preferable for the machine control system to make these adjustments automatically, or for the machine to be configured in a way that such adjustments are unnecessary.

A method of achieving correct pressure of the upper peripheral restraint assembly 70 on the logs, despite log diameter and firmness variation, is to implement a pneumatic actuator 72. This may be done in combination with a servo motor position control 74 for positioning a carriage 76 via a crank assembly 78. As a first non-limiting example, the coupler in a slider crank mechanism for the upper peripheral restraints position may be replaced with a pneumatic cylinder, where the crank is controlled by a servo motor. As a second non-limiting example, for instance as shown in FIGS. 12-15, a pneumatic "suspension system" may be applied to the upper peripheral restraint surfaces 80. The servo motor 74 for the upper peripheral restraint assembly 70 may operate in position mode, moving down to contact the logs according to the target log diameter. The servo motor 74 may be coupled to the carriage 76 with a slider crank mechanism 78. Each upper peripheral restraint surface 80 may be attached to a carriage 76 with a pair of cylinders 72, with one cylinder on the operator side of the machine, and one cylinder on the drive side of the machine. The downward pressure on the logs provided by these cylinders 72 may be entered by an operator at an HMI and set with a proportional regulator. If the logs are at target diameter and firmness, the pneumatic cylinders 72 retract an intermediate amount due to the contact pressure between the restraint surfaces 80 and the logs. If the logs are smaller than target diameter and/or lower in firmness, the cylinders 72 retract a lesser amount, to provide the correct pressure on the logs. If the logs are greater in diameter than target and/or greater in firmness, the cylinders 72 retract a greater amount to provide the correct pressure on the logs. Thus, the overall mode of operation of the peripheral restraint assemblies is a pressure mode. Because each restraint surface 80 has independent cylinders 72, it can adjust correctly to its own log. Because each restraint surface 80 has independent cylinders 72 at its operator and drive side ends, it can automatically adjust for log diameter taper from end to end as well. The pneumatic cylinders 72 may be provided with rod locking devices, which may engage to prevent further downward travel after the correct pressure is established. This may be especially beneficial for logs with low radial strength to resist crushing after the mandrel has been withdrawn. The reason a servo motor is used in conjunction with the pneumatic pressure control methods is to have a fast and precisely controlled actuation speed for the larger portion of restraint travel to the logs, yet still have pneumatic regulation to set the correct contact pressure on the logs.

However, for canister products, which are typically short in length, operation at higher cycle rates is of great value, because cycle rate, not web speed, is more often the limitation to faster production. Therefore, a method to achieve correct pressure of the upper peripheral restraint assembly 70 on the logs despite log diameter and firmness variation, which may be faster because a period of waiting for the pneumatics to equalize is not required, is disclosed below. The mechanical system is the same as when running with solely position control, with no pneumatic cylinders, nor other mechanically yielding members such as springs or elastomers. But control of the servo motor 74 for the upper peripheral restraint assembly 70 is configured to apply them in a quasi-pressure mode against the logs, based on torque feedback from the servo motor. After a set of logs is moved into their extraction position, the servo motor 74 moves the upper restraint surfaces 80 down toward their target position of log contact, based on the anticipated log diameter and the instructed amount of log compression. When near the target position at the logs, the control CON enables a PID control loop monitoring the torque feedback from the servo motor 74 to trim the position up or down to either relieve or add contact pressure on the log. The desired contact pressure is entered at an HMI. The weight of the carriage 76 may be determined through measurement. The mechanical advantage of the slider crank mechanism 78 and the weight of the carriage 76 are contributing factors for correctly interpreting the torque feedback and determining the amount of torque needed to be output by the servo motor 74 to apply the correct pressure on the logs. Once the mandrels 60 have begun extracting, the pressure control is disabled and the position of the upper restraint assembly 70 is held so as to not collapse the logs without mandrels. The upper peripheral restraint servo motor 74, gearbox type and ratio, and the mechanical advantage of the slider crank mechanism 78 are selected such that the system can discern the difference between the required applied contact pressure from the weight of the carriage 76. This method allows the correct pressure to be applied by the upper peripheral restraint assembly on the logs despite log diameter and firmness variation. The method tends to contribute to a faster cycle rate because a period of waiting for pneumatics to equalize is not required. This system is believed to be advantageous in that its electrical feedback and control may equalize faster to achieve the correct pressure on the logs than pneumatic pressure feedback and regulation can, which is beneficial in canister roll production, because it facilitates higher cycle rates of production. It is also simpler from a components standpoint, so may be less expensive to provide and have less maintenance. Lastly, this method may be beneficial for some cases of tissue/towel products as well, where an "independent suspension" for differences among the logs or for log diameter taper is not needed.

In the alternative, the diameter of the logs exiting the tail seal unit 26 could be measured in similar fashion to that described earlier for measuring the diameter of logs entering the tail seal unit 26, or the log diameter may be measured anywhere after the rewinder wind nest and before the peripheral restraints are applied, and the engagement heights of the upper and lower peripheral restraints 70,71 may be automatically adjusted based on the measured diameter. This may promote consistent line operation by taking the adjustment function away from the operators. In combination, or in the alternative, the pressure applied by the upper peripheral restraint assembly 70 may be measured as each log or set of logs is held for mandrel extraction, for example with a pressure-regulated air cylinder, and/or the diameter of each log or set of logs may be measured, for example via servo position feedback. Measuring the log diameter via servo position feedback may be done when operating in the quasi-pressure mode. This way the upper peripheral restraint assembly 70 varies in position according to log diameter and firmness, instead of going to the same target position each time as strict position control would do. Another way to measure log diameters in the extractor is to put piston position sensors on the pneumatic cylinders of the independent suspension system and monitor the stroke of the cylinders. For each cycle, the servo motor 74 moves the upper peripheral restraint carriage 76 to the same position, based on the target log diameter, and the pneumatic cylinders 72 stroke differing amounts based on the actual log diameter. These servo position data and cylinder position data can be combined to ascertain the actual heights of the peripheral restraints on the logs, and thereby derive a log diameter. These methods do not yield exact log diameter directly, because the position of the engagement surface 80 is influenced by both log diameter and log firmness. However, the information may be valuable and useful nonetheless. Any contact measurement method will compress the specimen somewhat; and as long as the contact pressure is maintained reasonably uniform from measurement to measurement, the data is good and useful. This may be true for all products, and may be especially true for products where log diameter variation comprises most of the total variation and log firmness variation comprises relatively little of the overall variation, such as may be the case for non-embossed webs and low bulk webs. Alternatively, if the log diameter is measured elsewhere, such as when exiting the tail seal unit 26, such as by a non-contact method, for instance by an optical sensor, for instance by a laser device (see FIG. 3, '82'), the measurement method of using feedback data of the peripheral restraints may still be used, and in combination with the non-contact log diameter measurement method yield both log diameter and precise log firmness information. Log diameter data may be used to control the engagement height of the upper peripheral restraint assembly 70, the engagement height of a lower peripheral restraint assembly, the operating height of the upper infeed belts 95 (FIG. 3), the operating height of the mandrel extractor pullers and opening in the log face restraints 68, and the log pick-up point 97 (FIG. 3) of the outfeed conveyor 90 according to the actual log diameter, rather than the target log diameter. This will tend to a more precisely controlled and robust process, more immune to web property and log characteristic variation, that may operate more reliably, and with less operator supervision and intervention, and may possibly be capable of operating at higher maximum cycle rates. This may also promote longer mandrel life, by ensuring that the mandrel extractor clasps on the pullers enter the mandrels in the center of the mandrel, thereby preventing damage to the mandrel end due to a poor alignment of the mandrel clasp to the mandrel. Log diameter data may be used in combination with log firmness data to control rewinding parameters, tail seal unit settings, extractor infeed belts compression, extractor outfeed metering belts compression, and other downstream equipment. Log firmness and/or diameter data may be fed back to the rewinder controller. Log firmness and/or diameter data may be tracked with the logs and fed forward to controllers in other modules in the converting line, and/or fed forward to the controller(s) in downstream equipment such as conveyors, roll converging equipment, roll diverging equipment, and stuffers. The pressure applied by the peripheral restraints and/or log engagement position of the peripheral restraints data may be interpreted as an indication of log firmness and/or changes in log firmness.

Figure 10:
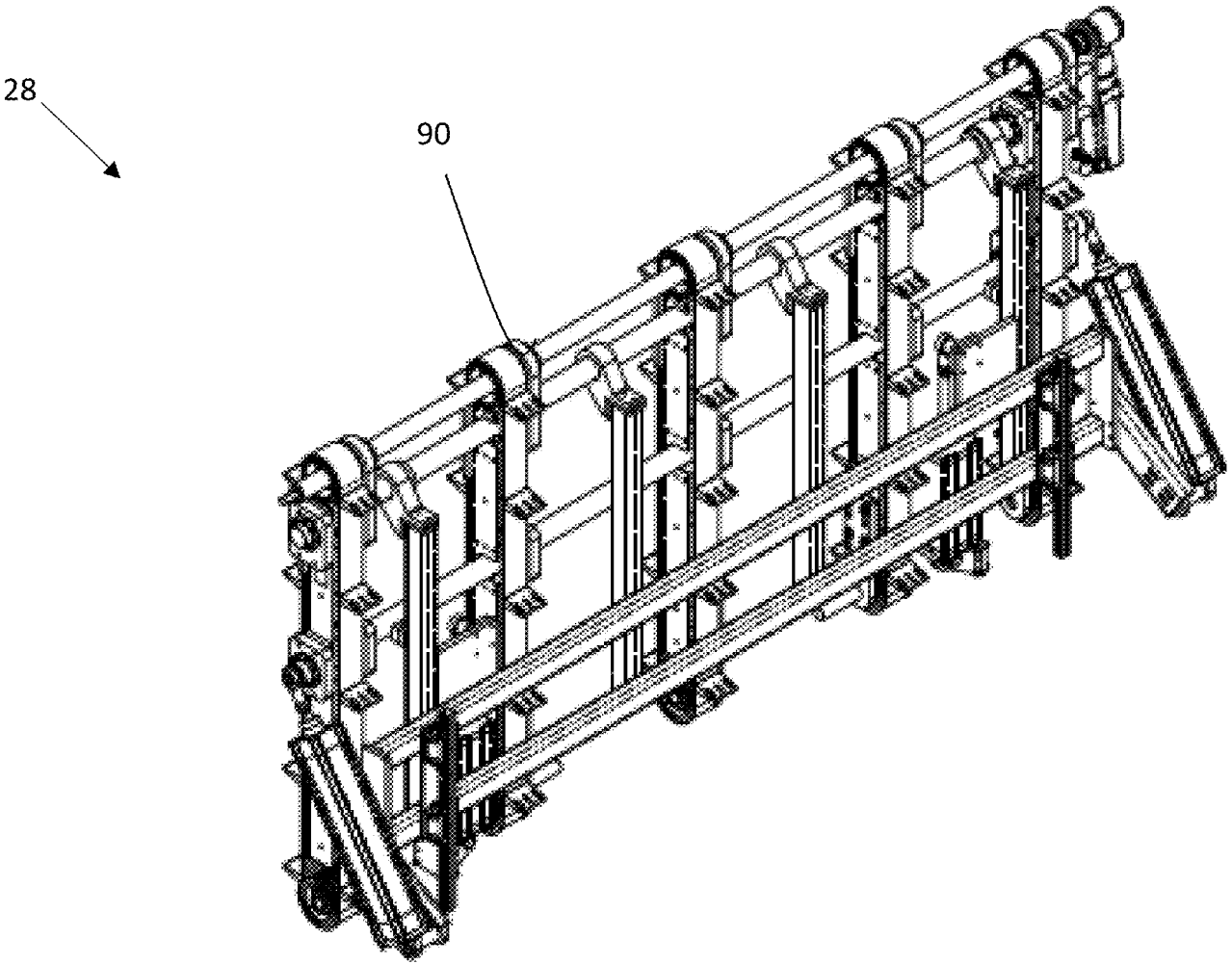
FIG. 10 is a perspective view of a flighted outfeed conveyor of a mandrel extractor in a maintenance position.
Figure 11:
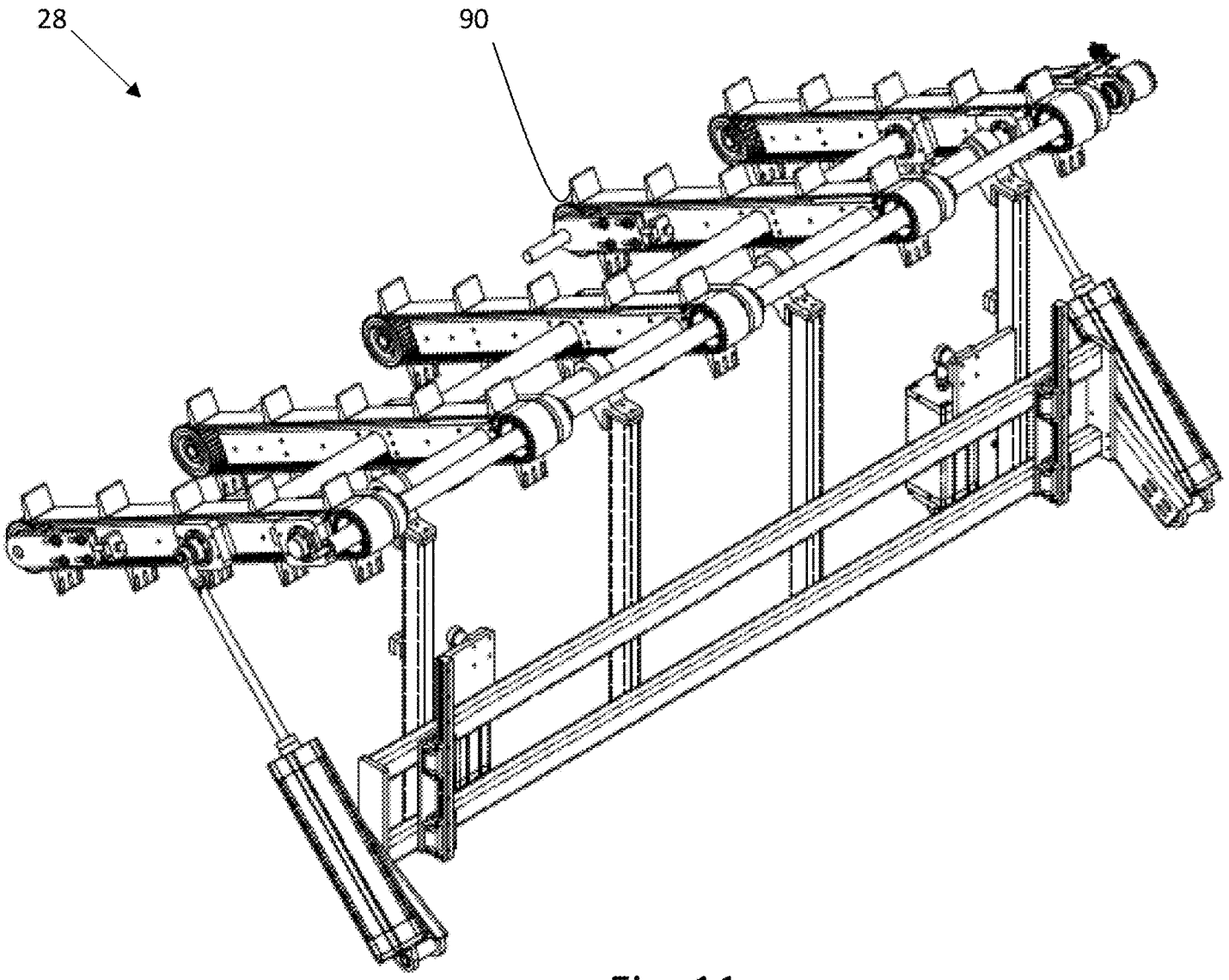
FIG. 11 is a perspective view of the flighted outfeed conveyor of FIG. 9 in a normal operating position.
Figure 12:
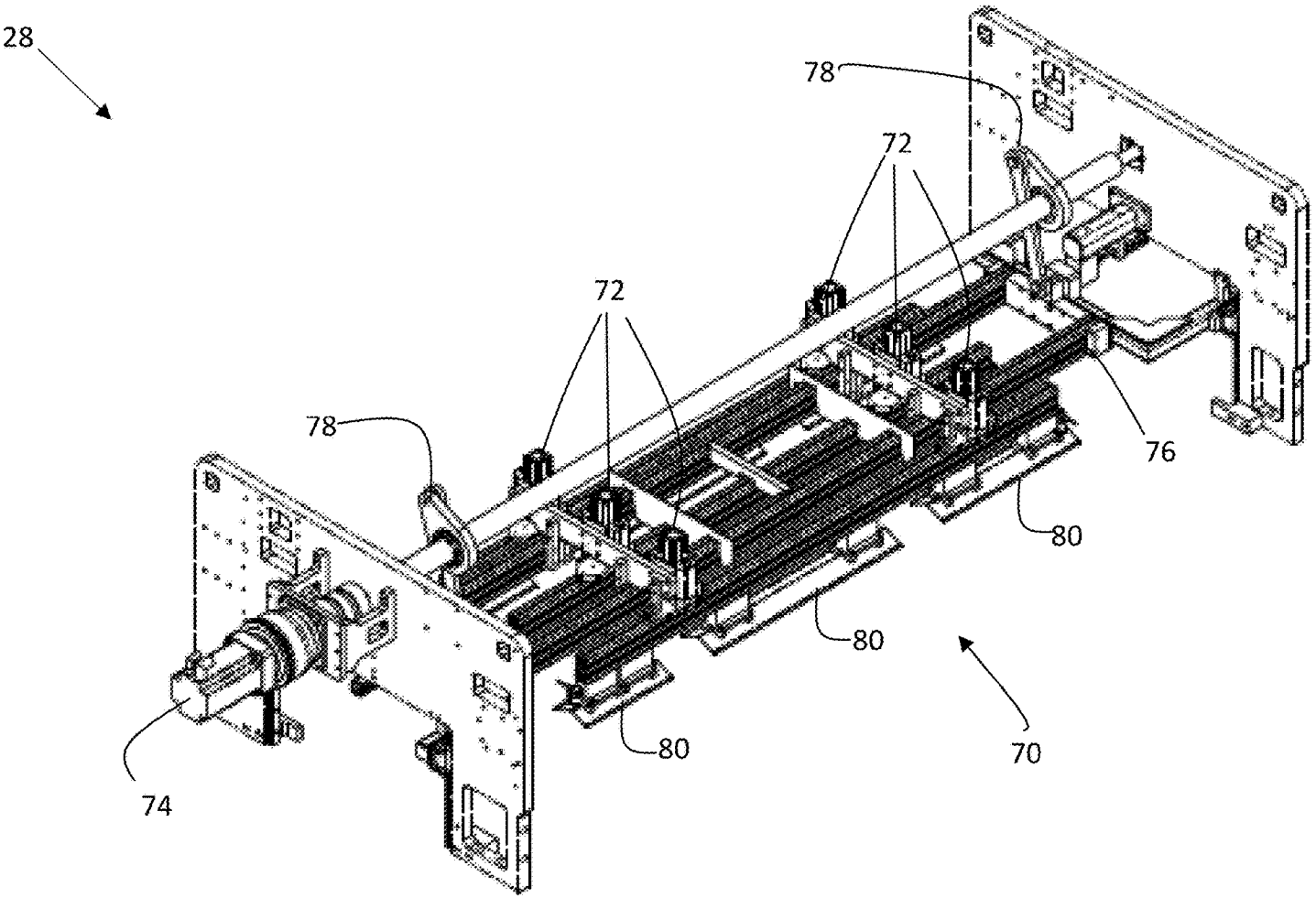
FIG. 12 is a perspective view of an upper peripheral restraint of a mandrel extractor provided with a "suspension" system.
Figure 13:
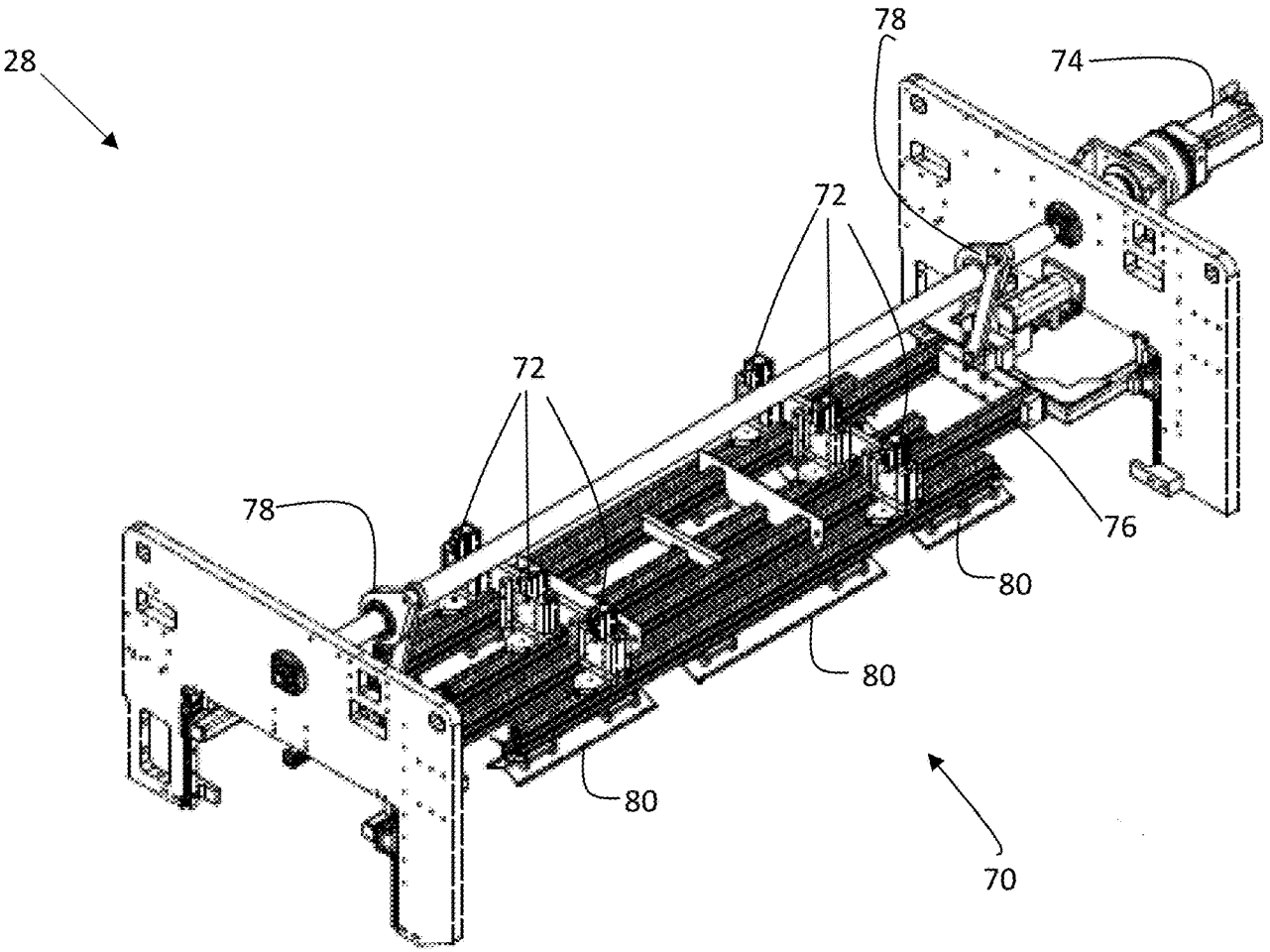
FIG. 13 is an alternate perspective view of the upper peripheral restraint of FIG. 12.
Figure 14:
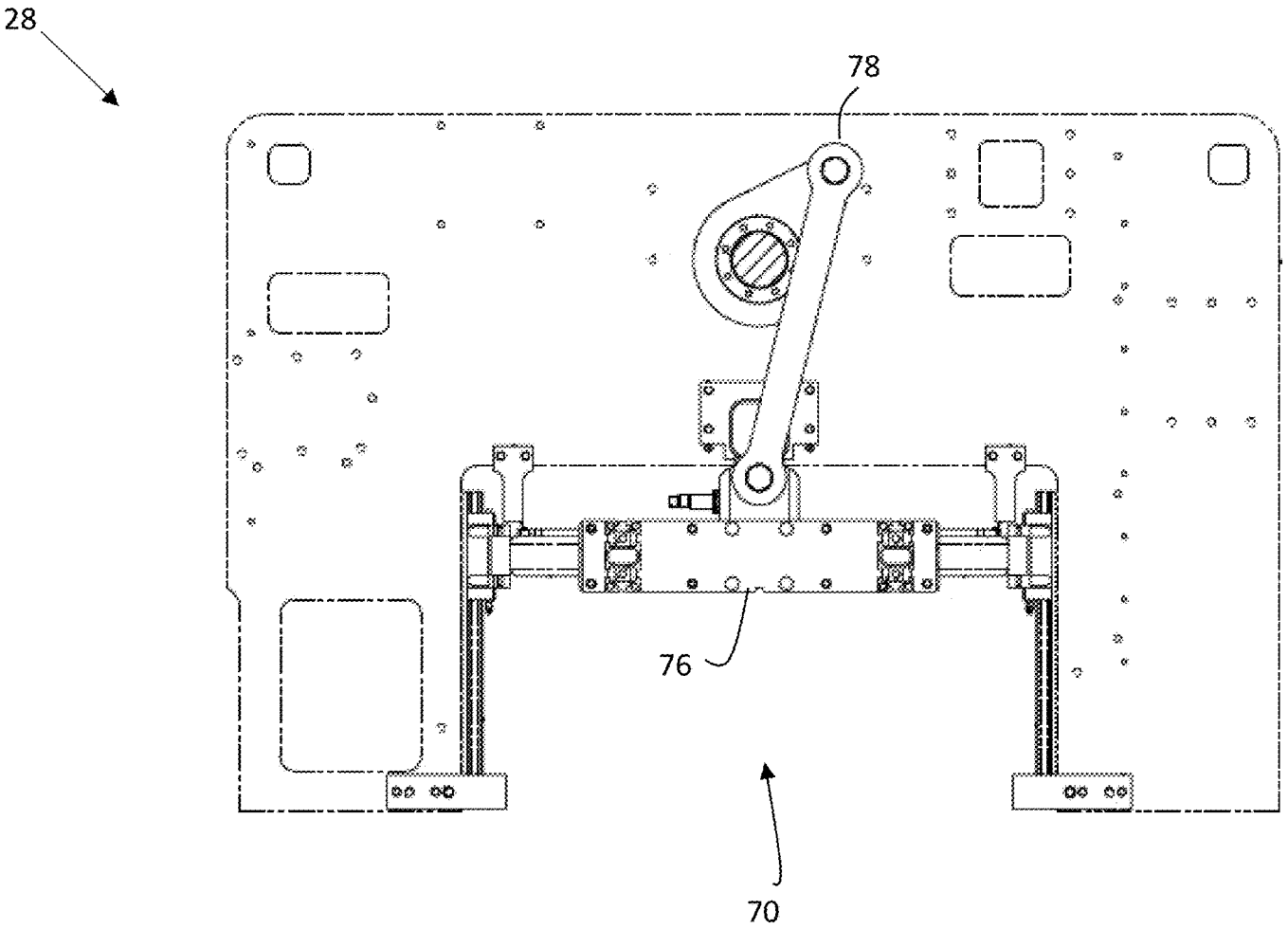
FIG. 14 is a cross sectional end of the crank arm and actuator of the upper peripheral restraint of FIG. 12.
Figure 15:
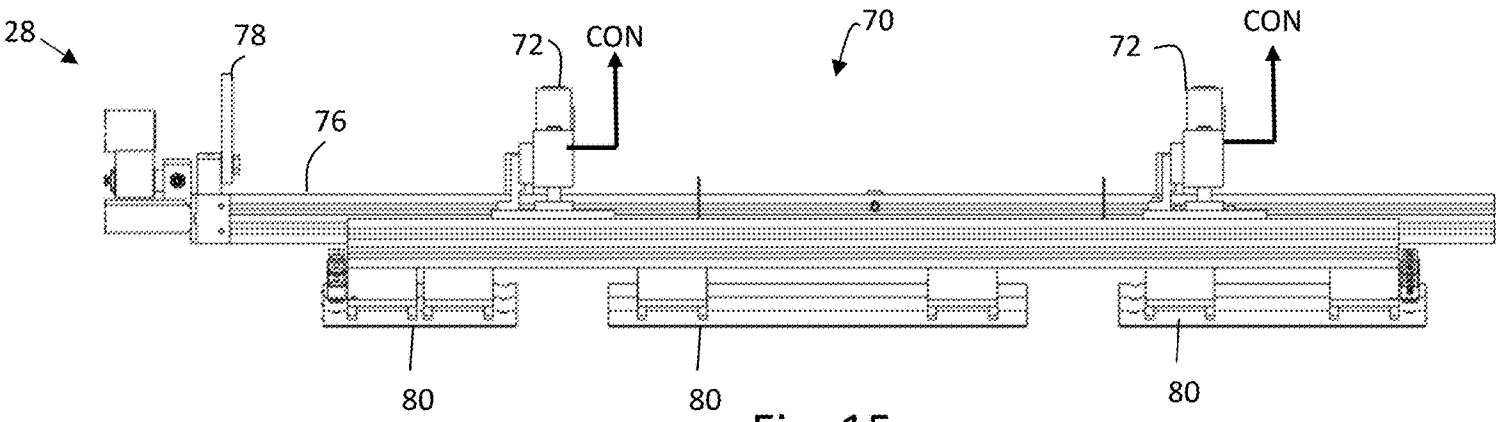
FIG. 15 is a side view of upper peripheral restraint of FIG. 12.
Figure 16:
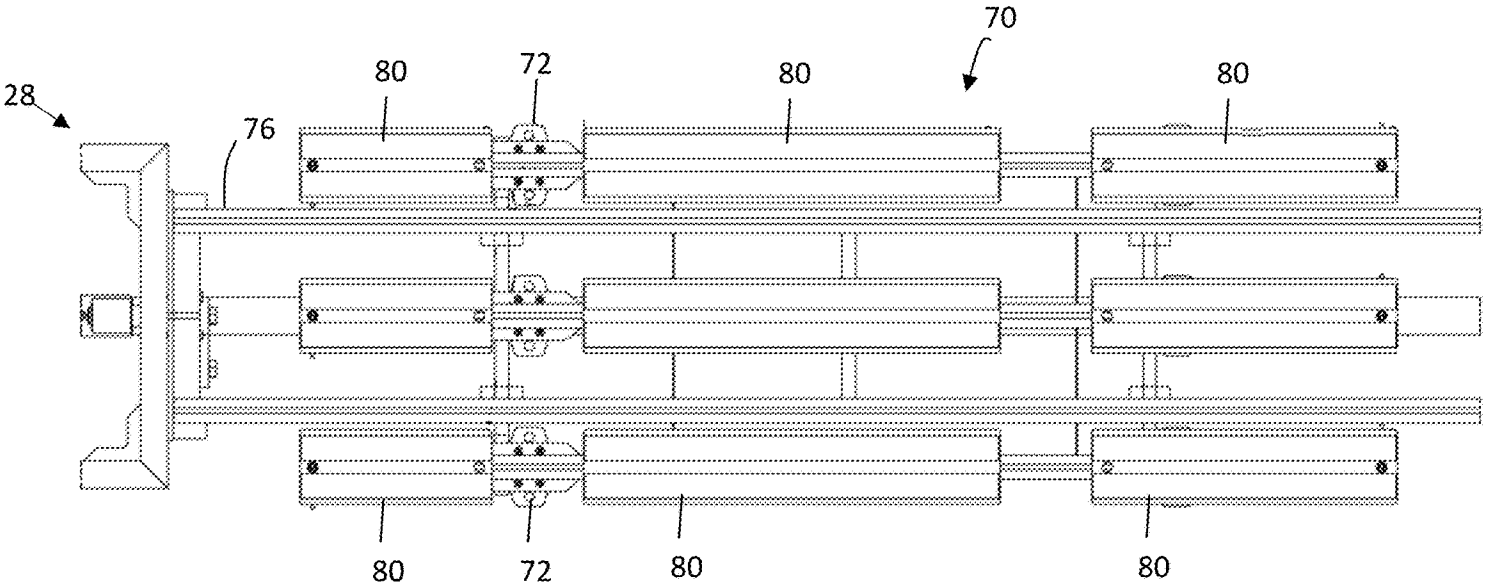
FIG. 16 is a top view of upper peripheral restraint of FIG. 12.

The standard tissue/towel outfeed of a mandrel extractor 28 is a simple table with overhead metering belts. For canister lines, as shown in FIGS. 10-11, a flighted conveyor 90 may be provided to support low-weight logs with low bending stiffness. A primary reason this type of conveyor 90 is used for canister nonwovens is that the logs do not have radial integrity to resist being crushed by the metering belts. The quantity of web wraps around the hole in these relatively short products is relatively few, and many of the substrates slide against themselves with insufficient inter-ply friction to prevent radial crushing and collapse of the logs when subjected to the pressure of the metering belts after the mandrels have been removed. So the result of using metering belts for many of these products would be that the logs are dented or partially crushed under the metering belts and do not roll under the control of the metering belts, but rather jam. And even if they do not jam, their central holes may be partly closed, rather than remain substantially circular. These problems and potential problems are avoided by using an outfeed flighted conveyor under the logs.

In the accumulator 30, additional "fingers" may be provided on the buckets to support low-weight logs with low bending stiffness. In the alternative, full-width buckets which support the entire log may be provided, but this may be more susceptible to logs becoming glued to the buckets and causing process upsets.

To compensate for varying web widths, either between parent rolls, throughout a parent roll, or as the web continues to grow after the logs are made, the cut length may be adjusted in the log saw 32. Log length can be measured just prior to logs being cut in the log saw. In the alternative, log length can be measured at any point in the line and tracked to the log saw. A target web width (equal to the log length), cut length (which, when divided into the web width results in an integer number of rolls per log), and cut length tolerance may be entered into the log saw human-machine interface (HMI). Provided that the measured log length divided by the number of rolls per log results in a new cut length within the cut length tolerance, the saw cut length setting can be reset to the new cut length. If the resulting new cut length is outside the cut length tolerance, the saw can revert to a mode in which trim cuts are taken, either with the desired number of rolls per log (if the log or logs are too long) or with one fewer roll than the desired number of rolls per log (if the log or logs are too short). With a log saw in accordance with U.S. Pat. No. 6,644,154, the cut length setting must be the same for all of the lanes in which logs are cut. With a log saw in accordance with U.S. Pat. No. 10,272,585, the cut length setting may be set for each individual lane. If a cut length adjustment is needed, the saw may pause long enough for its controller to recalculate cams, and then automatically restart cutting logs. In the alternative, the saw can continue running while it recalculates cams which take effect on the next group of logs to be cut, but that is not preferred. This method has obvious advantages over prior art in which the final cut length is made with slitters, whose position cannot be adjusted while the line is running. It also has advantages over a log saw without this feature, in which case all of the error in the web width would appear in the first roll cut by the log saw.

The diameter setting of the log saw clamps 92 of the log saw 32 may be adjusted based on the diameter(s) of the incoming logs. The diameter setting for all clamps may be set based the diameter of the largest log in the group of logs to be cut. The diameter setting of each clamp may be adjusted individually. The diameter of the logs may be measured in the log saw through external position sensors and/or sensor associated with the log saw clamps. The diameter of the logs may be measured prior to the log saw and tracked through the line.

Tissue and towel products for away from home use, such as those for restaurants, hotels, airports, and hospitals may also benefit from the methods described herein. In particular, away from home products dispensed by the end user from a dispenser may benefit: analogous to canister wipes rolls fitting into a canister, a primary goal of many away from home products is not their particular diameter or the look of their end cuts, but rather that the roll fits into the dispenser. The peripheral restraint assemblies 70 "suspension system" described above may be useful for such products, in particular such products which are firm or very firm, in particular also products where the logs tend to vary in diameter through the course of a parent roll, from parent roll to parent roll, and/or from one end to the other end of the logs.

Further embodiments can be envisioned by one of ordinary skill in the art after reading this disclosure. In other embodiments, combinations or sub-combinations of the above-disclosed invention can be advantageously made. The example arrangements of components are shown for purposes of illustration and it should be understood that combinations, additions, re-arrangements, and the like are contemplated in alternative embodiments of the present invention. Thus, various modifications and changes may be made thereunto without departing from the broader spirit and scope of the invention as set forth in the claims and that the invention is intended to cover all modifications and equivalents within the scope of the following claims.

What is claimed is:

1. A method of controlling a converting line, wherein the converting line includes a rewinding machine and a control system of the converting line, the method comprising:

winding a log of convolutely wound web material in the rewinding machine during a wind cycle;

determining a diameter of the log of convolutely wound web material wound in the rewinding machine at a plurality of time points during a time period of the winding cycle;

measuring a post-winding log diameter of the log at a position in the converting line downstream of the rewinding machine:

determining a caliper of the web material of the log of convolutely wound web material at corresponding time points during the time period of the winding cycle; and enabling the control system to generate a signal to change an operating condition of the converting line based upon: (a) at least one of (i) a diameter determination at a time point during the time period of the wind cycle, (ii) a caliper determination at a time point during the time period of the wind cycle, (iii) a wound web amount determination at a time point during the time period of the wind cycle, and (iv) a tension determination at a time point during the time period of the wind cycle; and (b) the post-winding log diameter.

2. The method of claim 1 further comprising determining an amount of tension of the web material at corresponding time points during the time period of the winding cycle with a sensor associated with at least one roller adapted and configured for guiding the web material through the converting line.

3. The method of claim 1 wherein the step of determining the caliper includes measuring a distance between a sensor and a surface of a roll of web material as the roll of the web material is unwound from an unwinder associated with the converting line.

4. The method of claim 1 further comprising:

determining log firmness at a point after winding of the log; and (c) enabling the control system to generate a signal to change an operating condition of the converting line based upon the determined log firmness.

5. The method of claim 4 wherein the step of winding the log of convolutely wound web material includes winding the log on a mandrel when the log is in a winding nest of the rewinding machine and subsequently extracting the mandrel from the log in an extractor when the log is away from the winding nest, and the step of determining log firmness comprises determining log firmness with a sensor associated with the extractor.

6. The method of claim 5 wherein the step of determining log firmness with the sensor associated with the extractor includes measuring torque associated with a motor of the extractor.

7. The method of claim 5, further comprising enabling the control system to generate a signal to change an operating condition of the extractor based upon the measured log firmness.

8. The method of claim 4 wherein the step of winding the log of convolutely wound web material includes winding the log on a mandrel when the log is in a winding nest of the rewinding machine and subsequently extracting the mandrel from the log in an extractor when the log is away from the winding nest, and the step of determining log firmness comprises measuring log firmness with a sensor associated with a peripheral restraint of the extractor.

9. The method of claim 8 wherein the step of measuring log firmness with the sensor associated with the peripheral restraint of the extractor includes measuring pressure applied by the peripheral restraint against the log positioned in the extractor.

10. The method of claim 8, further comprising enabling the control system to generate a signal to change an operating condition of the peripheral restraint of the extractor based upon the measured log firmness.

11. The method of claim 1 wherein the step of winding the log of convolutely wound web material includes winding the log on a mandrel when the log is in a winding nest of the rewinding machine and subsequently extracting the mandrel from the log in an extractor when the log is away from the winding nest, and the step of measuring the post-winding log diameter comprises measuring the post-winding log diameter with a sensor associated with the extractor.

12. The method of claim 11, further comprising enabling the control system to generate a signal to change an operating condition of the extractor based upon the measured the post-winding log diameter.

13. The method of claim 1 wherein the step of winding the log of convolutely wound web material includes winding the log on a mandrel when the log is in a winding nest of the rewinding machine and subsequently extracting the mandrel from the log in an extractor when the log is away from the winding nest, and the step of measuring the post-winding log diameter comprises measuring the post-winding log diameter with a sensor associated with a peripheral restraint of the extractor.

14. The method of claim 13, further comprising enabling the control system to generate a signal to change an operating condition of the peripheral restraint based upon the measured post-winding log diameter.

15. The method of claim 1 further comprising providing a tail seal unit in the converting line subsequent to the rewinding machine, and the step of measuring the post-winding log diameter after winding comprises measuring the post-winding log diameter with a sensor associated with the tail seal unit.

16. The method of claim 15 further comprising enabling the control system to generate a signal to change an operating condition of the tail seal unit based upon the measured post-winding log diameter.

17. The method of claim 1 further comprising providing a log saw in the converting line subsequent to the rewinding machine, and enabling the control system to generate a signal to change an operating condition of the log saw based upon the measured post-winding log diameter.

18. The method of claim 17 wherein the step of enabling the control system to generate the signal to change the operating condition of the log saw based upon the log diameter after winding includes adjusting log saw clamps based upon the measured post-winding log diameter.

19. The method of claim 1 further comprising:

providing an unwinder in the converting line prior to the rewinding machine; and enabling the control system to generate the signal to change the operating condition of the unwinder based upon: (a) the at least one of (i) the diameter determination at the time point during the time period of the wind cycle, (ii) the caliper determination at the time point during the time period of the wind cycle, (iii) the wound web amount determination at the time point during the time period of the wind cycle, and (iv) the tension determination at the time point during the time period of the wind cycle; and (b) the post-winding log diameter.

20. The method of claim 1 wherein the step of winding the log of convolutely wound web material in the rewinding machine during the wind cycle includes winding the web comprising a non-woven substrate.

21. The method of claim 1 wherein the converting line includes an unwinder followed by the rewinding machine followed by a tail seal unit followed by an extractor followed by an accumulator followed by a log saw, and the step of enabling the control system to generate the signal to change the operating condition of the converting line comprises changing an operating condition of at least one of the unwinder, the rewinder, the tail seal unit, the extractor, the accumulator, and the log saw.

22. A method of controlling a converting line, wherein the converting line includes a rewinding machine and a controller of a control system of the converting line, the method comprising:

winding a log of convolutely wound web material in the rewinding machine;

measuring a post-winding diameter of the log of convolutely wound web material at position in the converting line downstream of the rewinding machine, a caliper of the web material of the log of convolutely wound web material, and a log firmness of the log of convolutely wound web material; and enabling the controller to generate a signal to change an operating condition of the converting line based upon of the respective post-winding diameter measurement, the caliper measurement, and the log firmness measurement.

* * * * *